US010710833B2

(12) United States Patent
Mizutani

(10) Patent No.: US 10,710,833 B2
(45) Date of Patent: Jul. 14, 2020

(54) POST-PROCESSING APPARATUS, IMAGE FORMING SYSTEM AND CONTROL METHOD

(71) Applicant: TOSHIBA TEC KABUSHIKI KAISHA, Shinagawa-ku, Tokyo (JP)

(72) Inventor: Kikuo Mizutani, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/211,798

(22) Filed: Dec. 6, 2018

(65) Prior Publication Data

US 2020/0180891 A1 Jun. 11, 2020

(51) Int. Cl.
*B65H 33/06* (2006.01)
*B65H 33/08* (2006.01)
*B65H 33/10* (2006.01)

(52) U.S. Cl.
CPC ..... *B65H 33/06* (2013.01); *B65H 33/08* (2013.01); *B65H 33/10* (2013.01)

(58) Field of Classification Search
CPC ..... B65H 33/06; B65H 33/08; B65H 33/10
See application file for complete search history.

(56) References Cited

U.S. PATENT DOCUMENTS 5,513,839 A * 5/1996 Green ..... B42B 5/00 270/58.07
5,848,346 A * 12/1998 Takashiro ..... G03G 15/6538 399/404

FOREIGN PATENT DOCUMENTS

JP H03-205260 A 9/1991
JP H10-198101 A 7/1998
JP 2001-354352 A 12/2001

* cited by examiner

*Primary Examiner* — David H Bollinger
(74) *Attorney, Agent, or Firm* — Foley & Lardner LLP

(57) ABSTRACT

A post-processing apparatus includes a sheet discharge tray to which a sheet or a sheet bundle is discharged, and a shift mechanism configured to shift a discharge position of the sheet or the sheet bundle discharged to the sheet discharge tray from a reference position. The apparatus further includes a controller configured to control the shift mechanism to divide the sheet or the sheet bundle in a first direction in a direction orthogonal to a conveyance direction of the sheet or the sheet bundle and a second direction opposite to the first direction.

20 Claims, 13 Drawing Sheets

POST-PROCESSING APPARATUS, IMAGE FORMING SYSTEM AND CONTROL METHOD

FIELD

Embodiments described herein relate generally to a post-processing apparatus, an image forming system and a control method.

BACKGROUND

A post-processing apparatus for performing a post-processing on a sheet conveyed from an image forming apparatus (e.g., a MFP (Multi-Function Peripheral)) is known. The post-processing apparatus includes a processing section which performs a stapling operation or a sorting operation on the conveyed sheet, for example. The post-processing apparatus has a sheet discharge tray to which a sheet or a sheet bundle (printed matter) is discharged.

DETAILED DESCRIPTION

Figure 1:
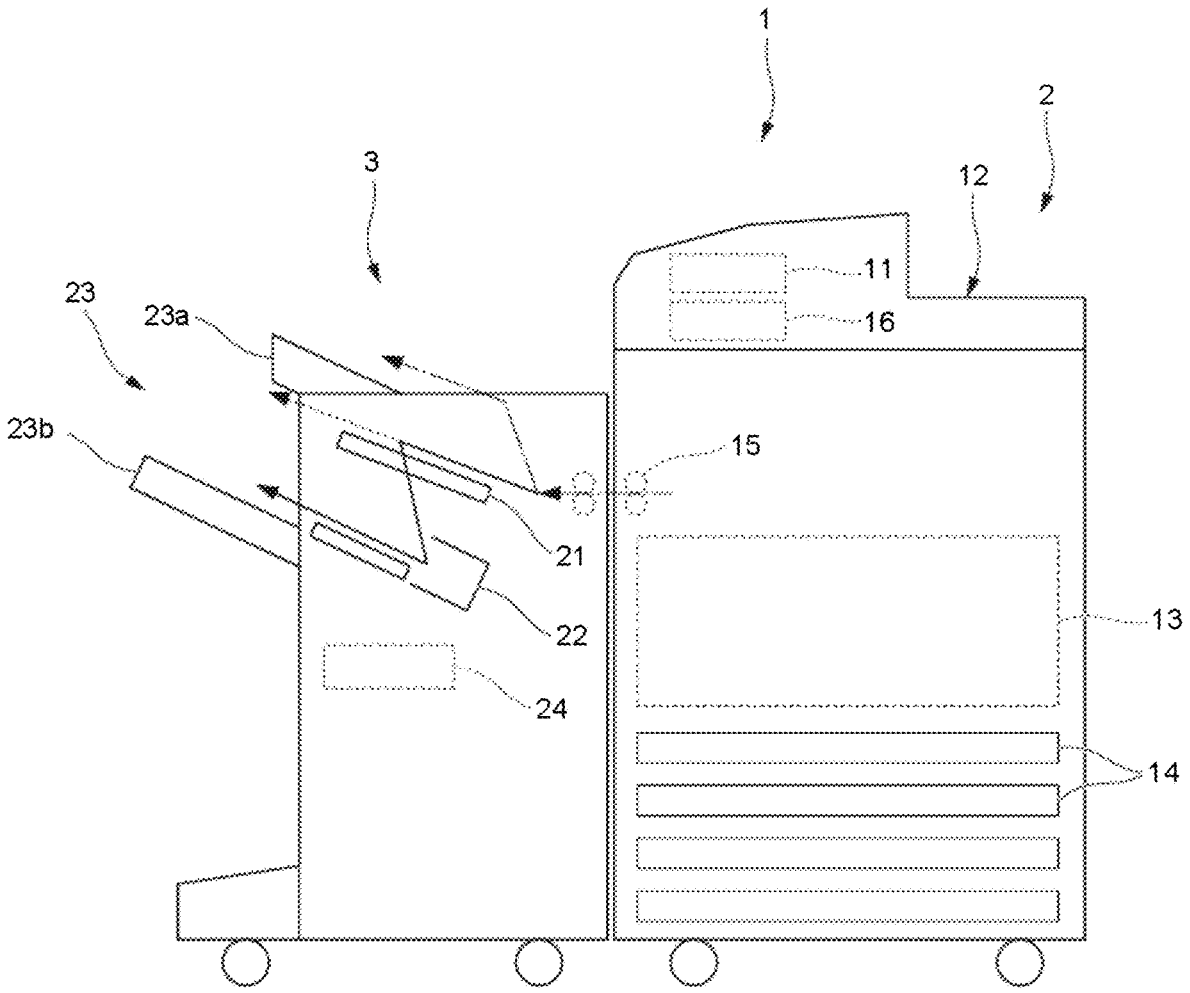
FIG. 1 is a front view illustrating an example of an image forming system according to some embodiments.

In some apparatuses, when plural users share an image forming apparatus and a post-processing apparatus, printed matter for plural users are mixed on the sheet discharge tray. If printed matter for plural users is mixed on the sheet discharge tray, boundaries of the printed matter cannot be known, and there is a possibility that it takes time to take out printed matter.

In accordance with at least one embodiment, a post-processing apparatus comprises a sheet discharge tray to which a sheet or a sheet bundle is discharged; a shift mechanism configured to shift a discharge position of the sheet or the sheet bundle discharged to the sheet discharge tray from a reference position; and a controller configured to control the shift mechanism to divide the sheet or the sheet bundle in a first direction in a direction orthogonal to a conveyance direction of the sheet or the sheet bundle and a second direction opposite to the first direction.

Hereinafter, a post-processing apparatus according to some embodiments is described with reference to the accompanying drawings. In the drawings, the same components are denoted with the same reference numerals.

FIG. 1 is a front view illustrating an example of an image forming system 1 according to some embodiments. As shown in FIG. 1, the image forming system 1 is provided with an image forming apparatus 2 and a post-processing apparatus 3. The image forming apparatus 2 forms an image on a sheet-like medium (hereinafter, also referred to as a "sheet") such as a sheet. The post-processing apparatus 3 executes a post-processing on the sheet conveyed from the image forming apparatus 2. The post-processing is an example of a "sheet processing apparatus".

The image forming apparatus 2 includes a control panel 11, a scanner section 12, a printer section 13, a sheet feed section 14, a sheet discharge section 15 and an image forming controller 16.

The control panel 11 is provided with various keys for receiving operations by a user. For example, the control panel 11 receives an input relating to a type of a post-processing carried out on the sheet. The control panel 11 sends information relating to the type of the input post-processing to the post-processing apparatus 3.

The scanner section 12 includes a reading section for reading image information to be copied. The scanner section 12 sends the read image information to the printer section 13.

The printer section 13 forms an output image (hereinafter, referred to as a "toner image") with a developer such as a toner according to the image information sent from the scanner section 12 or an external device. The printer section 13 transfers the toner image onto the surface of the sheet. The printer section 13 applies heat and pressure to the toner image transferred onto the sheet to fix the toner image on the sheet.

The sheet feed section 14 supplies sheets one by one to the printer section 13 in accordance with a timing at which the printer section 13 forms the toner image.

The sheet discharge section 15 conveys the sheet discharged from the printer section 13 to the post-processing apparatus 3.

The image forming controller 16 controls the whole operation of the image forming apparatus 2. The image forming controller 16 controls the control panel 11, the scanner section 12, the printer section 13, the sheet feed section 14 and the sheet discharge section 15. The image forming controller 16 is formed by a control circuit including a CPU (Central Processing Unit), a ROM (Read Only Memory), and a RAM (Random Access Memory).

Next, the post-processing apparatus 3 is described.

The post-processing apparatus 3 is arranged adjacent to the image forming apparatus 2. The post-processing apparatus 3 executes a post-processing designated through the control panel 11 on the sheet conveyed from the image forming apparatus 2. For example, the post-processing is a sorting processing or a stapling processing.

Figure 2:
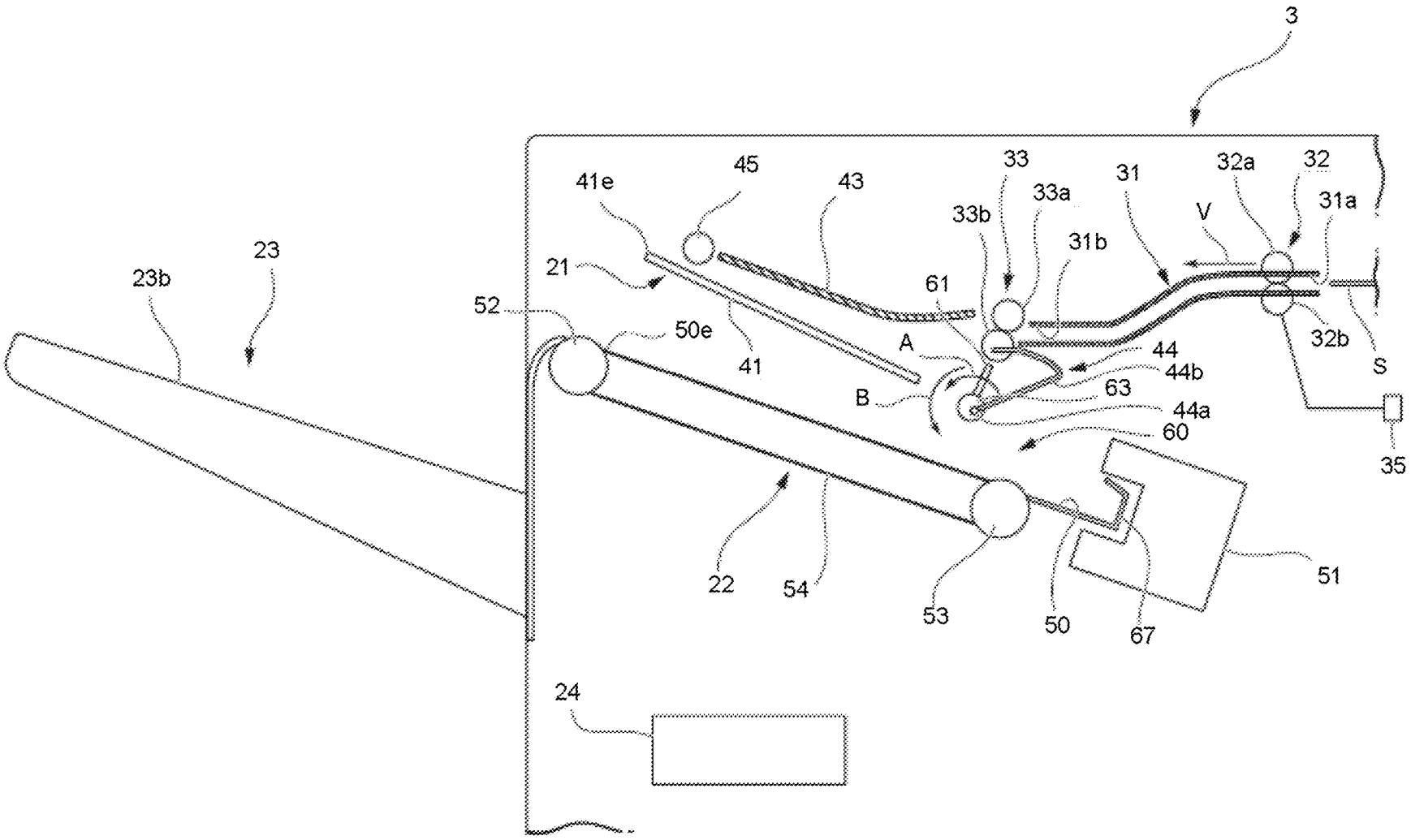
FIG. 2 is a cross-sectional view illustrating main portions of a post-processing apparatus according to some embodiments.

FIG. 2 is a cross-sectional view illustrating the main portions of the post-processing apparatus 3 according to some embodiments. As shown in FIG. 2, a conveyance path 31 is arranged in the post-processing apparatus 3. The post-processing apparatus 3 includes an entrance side conveyance section 32, an exit side conveyance section 33, a standby section 21, a processing section 22, a discharge section 23 and a post-processing controller 24.

First, the conveyance path 31 is described.

The conveyance path 31 is provided with a sheet supply port 31*a* and a sheet discharge port 31*b*.

The sheet supply port 31*a* faces the image forming apparatus 2 (refer to FIG. 1). The sheet supply port 31*a* is supplied with a sheet S from the image forming apparatus 2.

The sheet discharge port 31*b* is positioned nearby the standby section 21. The sheet S passing through the conveyance path 31 is discharged from the sheet discharge port 31*b* to the standby section 21 or the discharge section 23.

The entrance side conveyance section 32 is described.

The entrance side conveyance section 32 includes a pair of entrance rollers 32*a* and 32*b* and a sheet conveyance motor 35. The entrance rollers 32*a* and 32*b* are arranged nearby the sheet supply port 31*a*. The entrance rollers 32*a* and 32*b* are driven by the sheet conveyance motor 35. The entrance rollers 32*a* and 32*b* convey the sheet S supplied to the sheet supply port 31*a* towards the downstream side of the conveyance path 31. For example, the entrance rollers 32*a* and 32*b* convey the sheet S supplied to the sheet supply port 31*a* to the exit side conveyance section 33.

The exit side conveyance section 33 is described.

The exit side conveyance section 33 includes a pair of exit rollers 33*a* and 33*b*. The exit rollers 33*a* and 33*b* are arranged nearby the sheet discharge port 31*b*. The exit rollers 33*a* and 33*b* receive the sheet S conveyed by the entrance rollers 32*a* and 32*b*. The exit rollers 33*a* and 33*b* can convey the sheet S from the sheet discharge port 31*b* to the standby section 21 or the discharge section 23.

In some embodiments, the sheet S is conveyed from the image forming apparatus 2 to the discharge section 23. Hereinafter, in a conveyance direction V of the sheet S (hereinafter, referred to as a "sheet conveyance direction V"), the image forming apparatus 2 side is referred to as an "upstream side". In the sheet conveyance direction V, the discharge section 23 side is referred to as a downstream side.

The standby section 21 is described.

The standby section 21 temporarily retains (buffers) the sheet S conveyed from the exit side conveyance section 33. For example, a plurality of succeeding sheets S stands by on the standby section 21 while the processing section 22 performs the post-processing on the former sheet S. The standby section 21 is arranged above the processing section 22. If the processing section 22 is idle, the standby section 21 drops the sheet S being buffered towards the processing section 22.

Specifically, the standby section 21 includes a standby tray 41, an opening and closing drive section 42 (refer to FIG. 3), an assist guide 43, a chuck section 44 and conveyance rollers 45.

An upstream end of the standby tray 41 is positioned nearby the exit roller 33*b*. The upstream end of the standby tray 41 is positioned below the sheet discharge port 31*b* of the conveyance path 31. The standby tray 41 is tilted with respect to the horizontal direction so as to be positioned upwards at the downstream side of the sheet conveyance direction V. A plurality of the sheets S is stacked to stand by on the standby tray 41 while the processing section 22 executes the post-processing.

Figure 3:
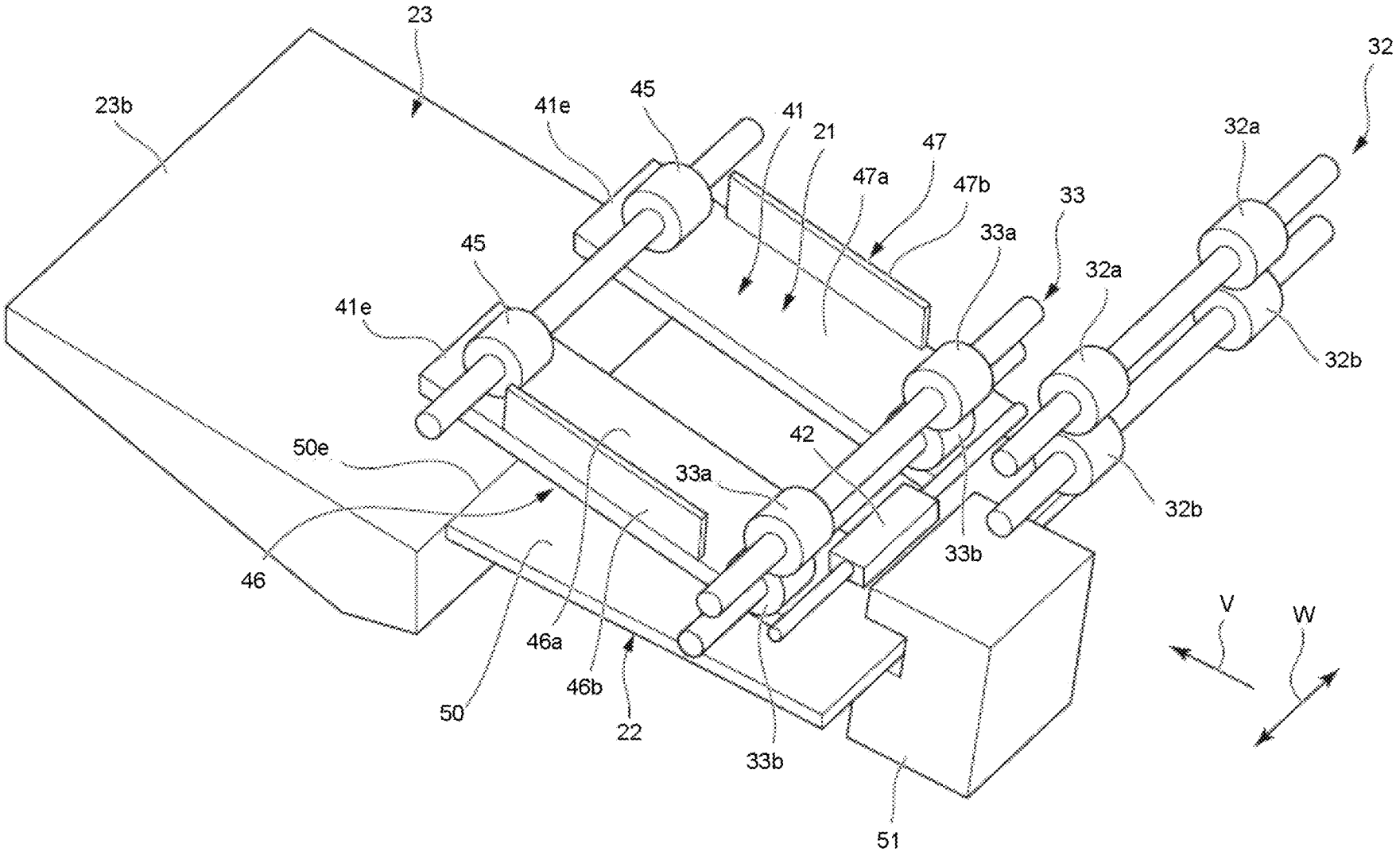
FIG. 3 is a perspective view illustrating main portions of the post-processing apparatus according to some embodiments.

FIG. 3 is a perspective view illustrating the main portions of the post-processing apparatus 3 according to some embodiments. As shown in FIG. 3, the standby tray 41 includes a first support member 46 and a second support member 47.

The first support member 46 and the second support member 47 are separated from each other in a direction intersecting the sheet conveyance direction V. Hereinafter, a width direction W of the sheet S is referred to as a "sheet width direction W". In some embodiments, the first support member 46 and the second support member 47 are substantially parallel to the horizontal direction and separated from each other in the sheet width direction W substantially orthogonal to the sheet conveyance direction V. The first support member 46 and the second support member 47 are movable in a direction of approaching each other and a direction of moving away from each other in the sheet width direction W.

The first support member 46 and the second support member 47 respectively have bottom walls 46*a* and 47*a* and side walls 46*b* and 47*b*. Each of the bottom walls 46*a* and 47*a* has a plate shape having a length in the sheet conveyance direction V. The bottom walls 46*a* and 47*a* can support the sheet S from below. The side walls 46*b* and 47*b* stand upwards from outer edges in the sheet width direction W of the bottom walls 46*a* and 47*a*. The side walls 46*b* and 47*b* can support the sides in the sheet width direction W of the sheet S.

The opening and closing drive section 42 is capable of driving the first support member 46 and the second support member 47 in a direction of approaching each other or in a direction of moving away from each other.

The opening and closing drive section 42 enables the first support member 46 and the second support member 47 to approach each other if the sheet S stands by on the standby tray 41. In this way, the sheet S is supported by the first support member 46 and the second support member 47.

The opening and closing drive section 42 enables the first support member 46 and the second support member 47 to separate from each other if the sheet S moves from the standby tray 41 to a processing tray 50 of the processing section 22. As a result, the sheet S supported by the standby tray 41 falls towards the processing tray 50 from a gap between the first support member 46 and the second support member 47. As a result, the sheet S moves from the standby tray 41 to the processing tray 50.

As shown in FIG. 2, the assist guide 43 is positioned above the standby tray 41. The assist guide 43 is a plate-shaped member extending above the standby tray 41. An upstream end of the assist guide 43 is positioned nearby the exit roller 33*a*. The upstream end of the assist guide 43 is positioned slightly above the sheet discharge port 31*b* of the conveyance path 31. The assist guide 43 bends gently to be positioned at the lower side at the downstream side of the sheet conveyance direction V and then bends and extends so as to be positioned at the upper side at the downstream side of the sheet conveyance direction V.

The sheet S discharged from the exit rollers 33*a* and 33*b* enters the gap between the assist guide 43 and the standby tray 41. The sheet S entering the standby section 21 is guided by the assist guide 43 and the standby tray 41 to move towards the rear side of the standby section 21.

The chuck section 44 is arranged at the upstream side of the standby tray 41 in the sheet conveyance direction V. The chuck section 44 can maintain the height of the uppermost surface of the sheet S conveyed to the standby tray 41 at a constant height. The chuck section 44 pushes the upstream end of the sheet S conveyed to the standby tray 41 towards the standby tray 41 by rotation of the chuck section 44.

Specifically, the chuck section 44 includes a rotation axis 44*a* and an arm portion 44*b*.

The rotation axis 44*a* is positioned at the upstream side of the standby tray 41 in the sheet conveyance direction V. The rotation axis 44*a* is positioned below the standby tray 41. The rotation axis 44*a* extends in the sheet width direction W. The chuck section 44 is rotatable in an arrow A direction around the rotation axis 44*a*. An L-shaped arm portion 44*b* is attached to the rotation axis 44*a*.

For example, the chuck section 44 presses the upstream end of the sheet S towards the standby tray 41 by being rotated according to a timing at which the sheet S is discharged from the exit rollers 33*a* and 33*b* towards the standby tray 41. In this way, the upstream end of the sheet S can be suppressed from floating on the standby tray 41.

The conveyance rollers 45 are arranged nearby a downstream end 41*e* of the standby tray 41. As shown in FIG. 3, the conveyance rollers 45 are movable in a direction of approaching the bottom walls 46*a* and 47*a* of the standby tray 41 and in a direction of moving away from the bottom walls 46*a* and 47*a* of the standby tray 41. The conveyance rollers 45 can move the sheet S to a fixed position on the bottom walls 46*a* and 47*a* of the standby tray 41 if the sheet S stands by on the standby tray 41.

The processing section 22 is described.

The processing section 22 carries out the post-processing on the sheet S. For example, the processing section 22 aligns a plurality of sheets S. The processing section 22 carries out a stapling processing on a plurality of aligned sheets S. As a result, a plurality of the sheets S is bound together. The processing section 22 discharges the sheet S on which the post-processing is carried out to the discharge section 23.

As shown in FIG. 2, the processing section 22 includes the processing tray 50, a stapler 51, driving rollers 52 and 53 and a conveyance belt 54.

As shown in FIG. 3, the processing tray 50 is positioned below the standby tray 41. The processing tray 50 can stack the sheet S. The processing tray 50 is tilted with respect to the horizontal direction so as to be positioned at the upper side at the downstream side of the sheet conveyance direction V. In some embodiments, the processing tray 50 is tilted somewhat more gently than the standby tray 41 in the horizontal direction. In the sheet conveyance direction V, a downstream end 50*e* of the processing tray 50 is positioned at the downstream side of the downstream end 41*e* of the standby tray 41. The plurality of sheets S moving to the processing tray 50 is aligned in the sheet width direction W and the sheet conveyance direction V by a longitudinal alignment mechanism 60 and a horizontal alignment mechanism 70 (refer to FIG. 4).

The stapler 51 is provided at the end of the processing tray 50. The stapler 51 staples (binds) a bundle composed of a predetermined number of the sheets S positioned on the processing tray 50.

As shown in FIG. 2, the driving rollers 52 and 53 are arranged at a predetermined interval in the sheet conveyance direction V. The conveyance belt 54 is stretched over the driving rollers 52 and 53. As viewed from the sheet width direction W, the downstream end of the conveyance belt 54 overlaps with the downstream end 50*e* of the processing tray 50. The conveyance belt 54 is rotated synchronously with the driving rollers 52 and 53. The conveyance belt 54 can convey the sheet S between the stapler 51 and the movable tray 23*b*.

Figure 4:
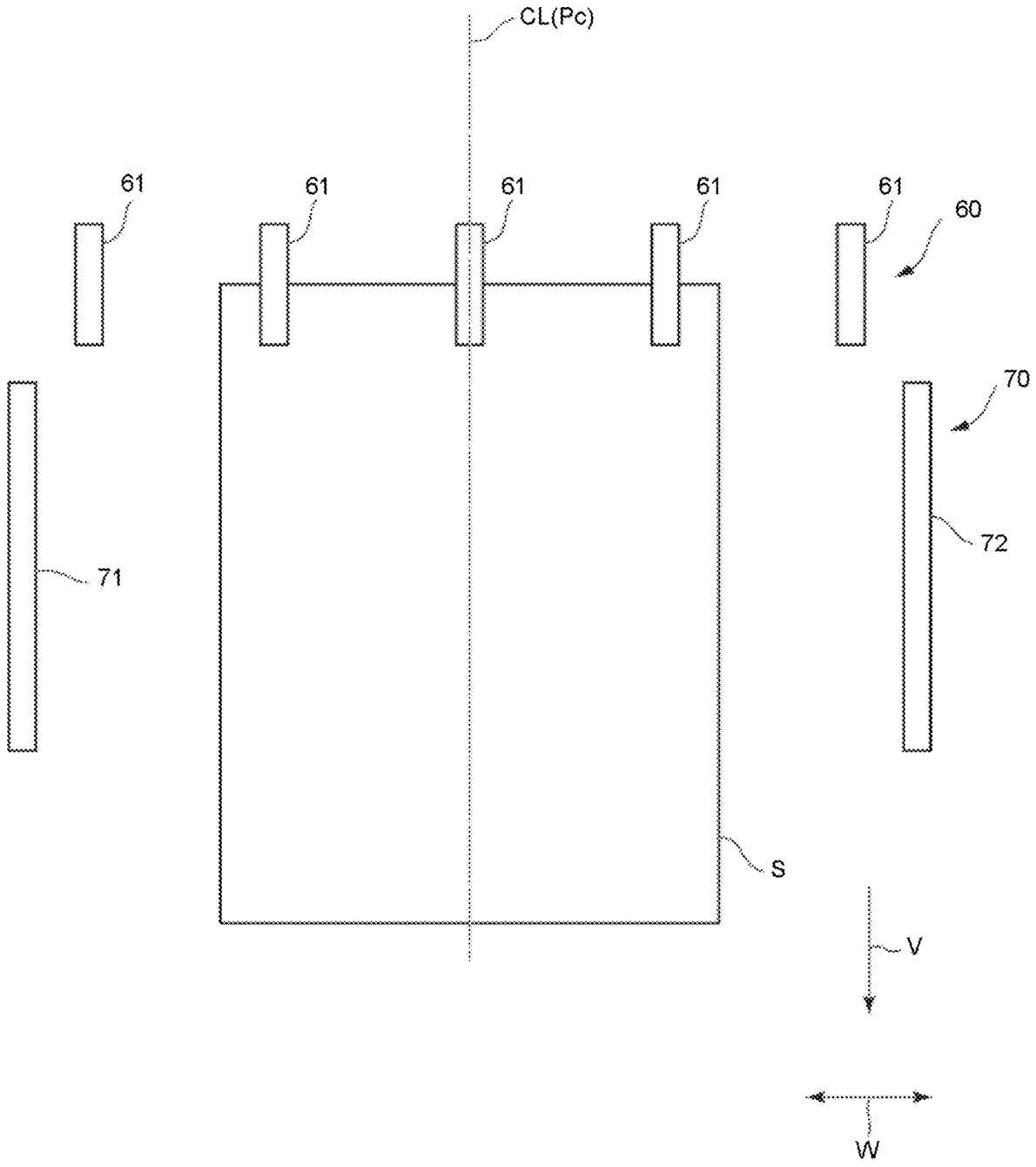
FIG. 4 is a plan view of a processing section according to some embodiments.

FIG. 4 is a plan view of the processing section 22 according to some embodiments. In FIG. 4, the illustration of the stapler 51, the driving rollers 52 and 53, the conveyance belt 54 and the processing tray 50 is omitted.

As shown in FIG. 4, the processing section 22 includes the processing tray 50 (refer to FIG. 3), the longitudinal alignment mechanism 60 and the horizontal alignment mechanism 70.

First, the longitudinal alignment mechanism 60 is described.

The longitudinal alignment mechanism 60 includes a rotatable paddle 61. The longitudinal alignment mechanism 60 can align the sheet S placed on the processing tray 50 in the sheet conveyance direction V. As shown in FIG. 2, the paddle 61 is placed between the standby tray 41 and the processing tray 50. The paddle 61 is positioned at the upstream side of the standby tray 41 and above the processing tray 50. The paddle 61 moves the sheet S falling onto the processing tray 50 towards the stapler 51. The paddle 61 is rotatable in an arrow B direction around a shaft 63.

For example, the paddle 61 is formed by an elastic material such as rubber. For example, the paddle 61 contacts with the upper surface of the sheet S positioned at the uppermost position among a plurality of sheets S falling onto the processing tray 50 by being rotated. The paddle 61 is further rotated in a state of contacting with the upper surface of the sheet S, thereby moving the sheet S towards the stapler 51.

As shown in FIG. 4, the longitudinal alignment mechanism 60 includes a plurality of paddles 61. In the example in FIG. 4, five paddles 61 arranged at intervals in the sheet width direction W are shown. The longitudinal alignment mechanism 60 includes a driving motor 64 (refer to FIG. 5) that issues a driving force for rotating the paddle 61 around the axis of the shaft 63 (refer to FIG. 2). A rotational power from the driving motor 64 is transmitted to the paddle 61 via a power transmission mechanism (not shown).

As shown in FIG. 2, at the upstream end of the processing tray 50, a stopper 67 is provided. The pair of stoppers 67 is arranged at intervals in the sheet width direction W. Due to the rotation of the paddle 61, the sheet S placed on the processing tray 50 is conveyed towards the stopper 67. The longitudinal alignment mechanism 60 performs the alignment (so-called longitudinal alignment) of the sheet S in the sheet conveyance direction V by enabling the sheet S to contact with the stopper 67.

Next, the horizontal alignment mechanism 70 is described.

As shown in FIG. 4, the horizontal alignment mechanism 70 includes horizontal alignment plates 71 and 72 movable in the sheet width direction W. The horizontal alignment mechanism 70 can align the sheet S placed on the processing tray 50 (refer to FIG. 2) in the sheet width direction W. The horizontal alignment mechanism 70 includes a plurality of the horizontal alignment plates 71 and 72. In some embodiments, the horizontal alignment mechanism 70 includes two horizontal alignment plates 71 and 72. The two horizontal alignment plates 71 and 72 are a first horizontal alignment plate 71 and a second horizontal alignment plate 72 separated from each other in the sheet width direction W.

Figure 5:
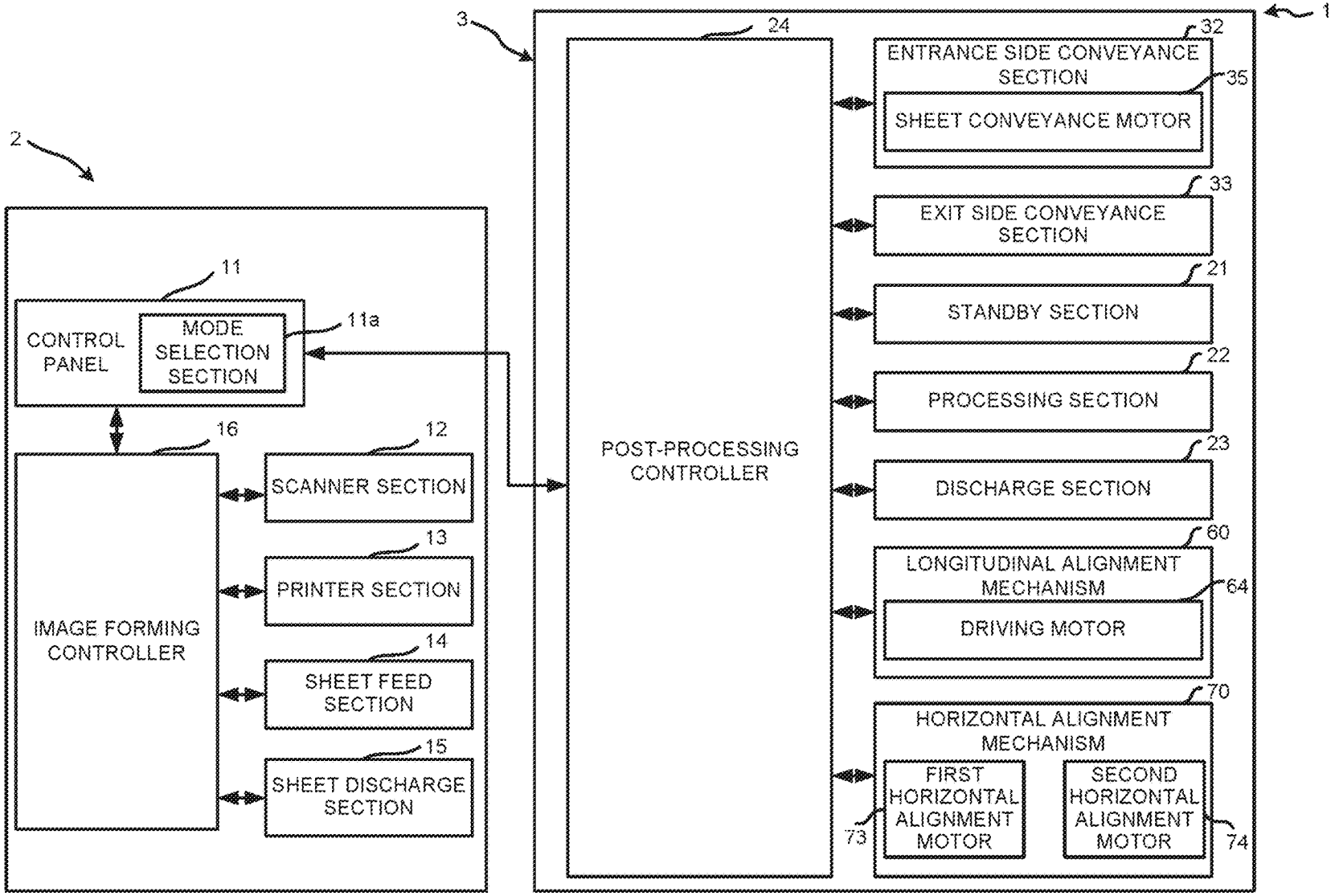
FIG. 5 is a block diagram illustrating an example of the image forming system according to some embodiments.

The horizontal alignment mechanism 70 includes a first horizontal alignment motor 73 and a second horizontal alignment motor 74 (refer to FIG. 5). The first horizontal alignment plate 71 and the second horizontal alignment plate 72 are driven by the first horizontal alignment motor 73 and the second horizontal alignment motor 74, respectively. The first horizontal alignment motor 73 is the driving motor for the first horizontal alignment plate 71. The second horizontal alignment motor 74 is the driving motor for the second horizontal alignment plate 72. By driving the first horizontal alignment motor 73 and the second horizontal alignment motor 74, the first horizontal alignment plate 71 and the second horizontal alignment plate 72 are movable in a direction of approaching each other and a direction of moving away from each other in the sheet width direction W. Due to the approach and separation of the first horizontal alignment plate 71 and the second horizontal alignment plate 72, the horizontal alignment mechanism 70 performs alignment of the sheet (so-called horizontal alignment) in the sheet width direction W. The horizontal alignment mechanism 70 is an example of a "shift mechanism," as may also be referred to as a "shifter."

The discharge section 23 is described.

As shown in FIG. 1, the discharge section 23 includes a fixed tray 23*a* and a movable tray 23*b*. The fixed tray 23*a* is provided at the upper side of the post-processing apparatus 3. The movable tray 23*b* is provided at the side of the post-processing apparatus 3. The sorted sheets S are discharged to the fixed tray 23*a* and the movable tray 23*b*. The sheet or the sheet bundle passing through the shift mechanism is discharged to the movable tray 23*b*. The movable tray 23*b* is an example of a "sheet discharge tray".

Next, the post-processing controller 24 is described.

FIG. 5 is a block diagram illustrating an example of the image forming system 1 according to some embodiments. As shown in FIG. 5, the post-processing controller 24 controls the whole operation of the post-processing apparatus 3. In other words, the post-processing controller 24 controls the entrance side conveyance section 32, the exit side conveyance section 33, the standby section 21, the processing section 22, the discharge section 23, the longitudinal alignment mechanism 60 and the horizontal alignment mechanism 70. The post-processing controller 24 is formed by a control circuit including a CPU, a ROM, and a RAM. The post-processing controller 24 is an example of a "controller".

For example, the post-processing controller 24 controls switching between a processing mode and a non-processing mode (normal mode). Here, the processing mode means a mode in which the post-processing is performed on the sheet S. For example, the processing mode includes a sorting mode and a stapling mode. The non-processing mode means a mode in which the sheet S is conveyed as it is without being subjected to the post-processing.

The control panel 11 includes a mode selection section 11*a* capable of selecting the processing mode and the non-processing mode. For example, the mode selection section 11*a* is a button provided on the control panel 11. If a user selects the "processing mode" at the time of mode selection and presses the button, the post-processing controller 24 executes the post-processing on the sheet S. On the other hand, if the user selects the "non-processing mode" at the time of mode selection and presses the button, the post-processing controller 24 does not execute the post-processing on the sheet S and discharges the sheet S without any change.

At the time of not conveying the sheet S, the post-processing controller 24 controls the sheet conveyance motor 35 in such a manner that the sheet conveyance motor 35 generates a driving power to rotate the paddle 61 (refer to FIG. 2). That the sheet S is not conveyed refers to a case in which the sheet conveyance motor 35 does not drive the entrance rollers 32*a* and 32*b*. For example, when the entrance rollers 32*a* and 32*b* are not driven, the sheet conveyance motor 35, alone or in conjunction with the driving motor 64, rotates the paddle 61.

Next, an example of the alignment operation of the sheet S in some embodiments is described.

In the processing tray 50, the longitudinal alignment of the sheet S by the longitudinal alignment mechanism 60 and the horizontal alignment of the sheet S by the horizontal alignment mechanism 70 are performed. For example, before the sheet S is placed on the processing tray 50, the post-processing controller 24 controls at least one of the first horizontal alignment motor 73 and the second horizontal alignment motor 74 to separate the first horizontal alignment plate 71 and the second horizontal alignment plate 72 from each other. A separation distance between the first horizontal alignment plate 71 and the second horizontal alignment plate 72 is wider than the width of the sheet S (refer to FIG. 4). Before the sheet S is placed on the processing tray 50, the post-processing controller 24 controls the driving motor 64 to rotate the paddle 61 to separate the paddle 61 from the upper surface of the sheet S placed on the processing tray 50. In other words, the driving motor 64 stops with the paddle 61 floating in the air without contacting with the upper surface of the sheet S.

After the sheet S is placed on the processing tray 50, the post-processing controller 24 controls at least one of the first horizontal alignment motor 73 and the second horizontal alignment motor 74 to bring the first horizontal alignment plate 71 and the second horizontal alignment plate 72 close to each other (refer to FIG. 6 and FIG. 7) in a state in which the paddle 61 is separated from the upper surface of the sheet S. Due to the approach between the first horizontal alignment plate 71 and the second horizontal alignment plate 72, the horizontal alignment mechanism 70 performs the horizontal alignment of the sheet S.

The post-processing controller 24 controls the driving motor 64 to rotate the paddle 61 to convey the sheet S towards the stopper 67 after the sheet S is placed at a predetermined longitudinal alignment position. By enabling the sheet S to abut against the stopper 67, the longitudinal alignment mechanism 60 performs the longitudinal alignment of the sheet S.

After the sheet S is placed at a predetermined horizontal alignment position, the post-processing controller 24 controls at least one of the first horizontal alignment motor 73 and the second horizontal alignment motor 74 to separate the first horizontal alignment plate 71 and the second horizontal alignment plate 72 from each other to enable them to return to the original positions.

If the stapling mode is selected, the post-processing controller 24 controls the stapler 51 (refer to FIG. 2) to perform a stapling processing on a bundle composed of a plurality of sheets S placed on the processing tray 50. Hereinafter, one sheet that is not subjected to the stapling processing is also referred to as a "sheet", a bundle composed of a plurality of sheets is referred to as a "sheet bundle", and the sheet or the sheet bundle is referred to as a "printed matter".

Next, an example of a shift operation of the printed matter in some embodiments is described.

Figure 6:
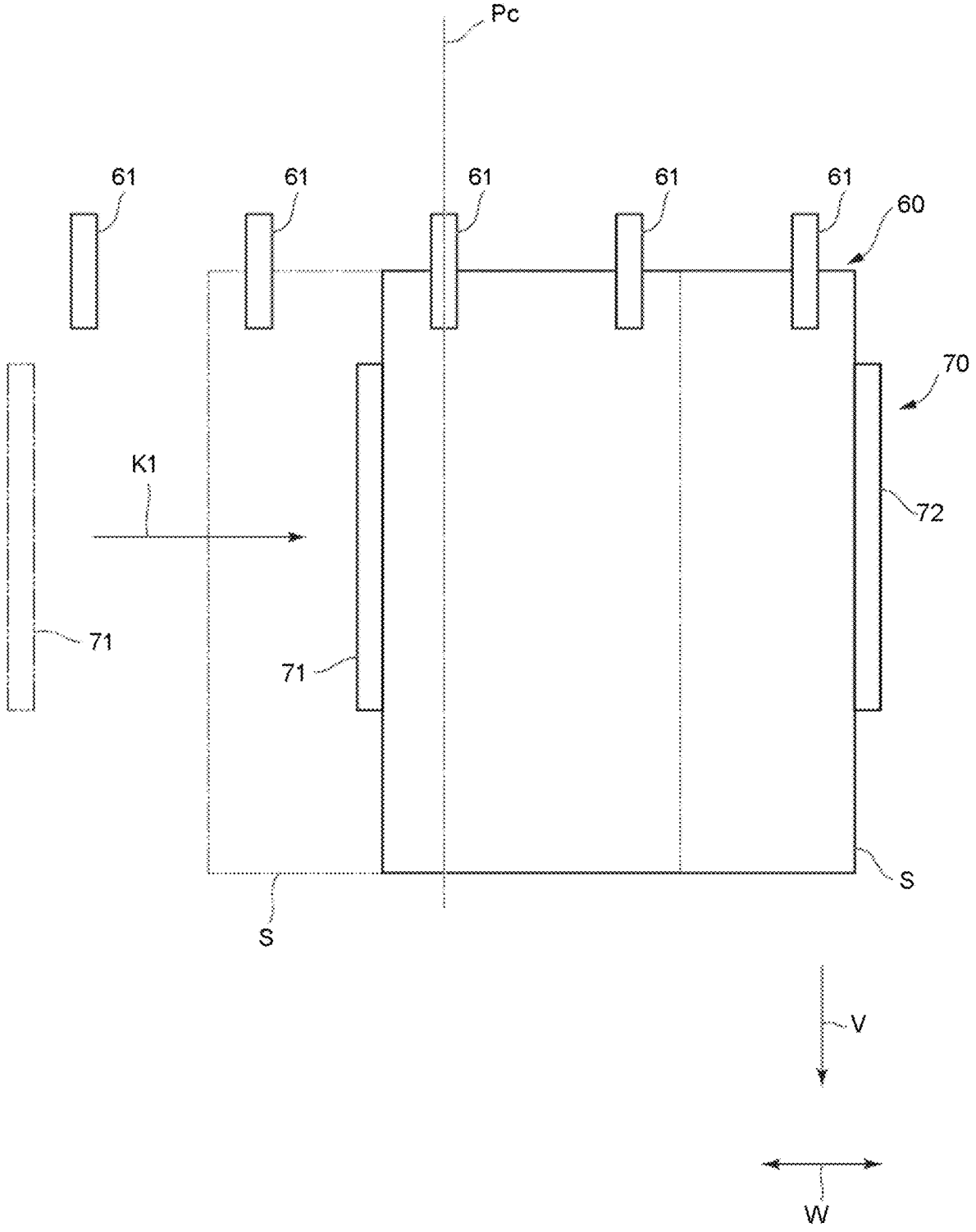
FIG. 6 is a diagram illustrating a shift operation towards a first direction according to some embodiments.
Figure 7:
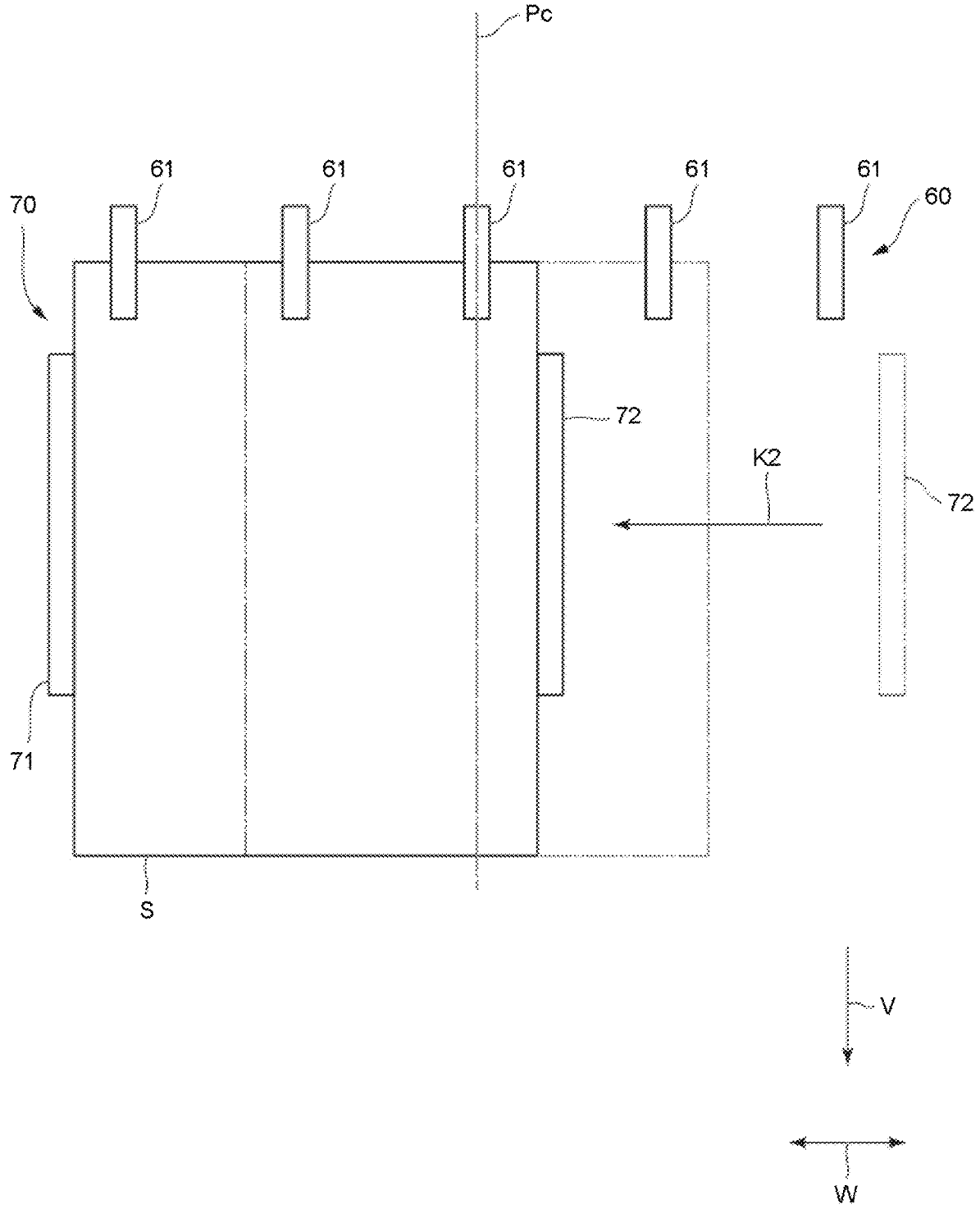
FIG. 7 is a diagram illustrating a shift operation towards a second direction according to some embodiments.

FIG. 4 is a diagram illustrating a reference position of the printed matter according to some embodiments. FIG. 6 is a diagram illustrating a shift operation of the printed matter in a first direction according to some embodiments. FIG. 7 is a diagram illustrating a shift operation of the printed matter in a second direction according to some embodiments. In the following drawings, a reference numeral CL indicates a center line of the printed matter in the sheet width direction W.

The post-processing controller 24 controls the horizontal alignment mechanism 70 to divide the printed matter into a first direction in the sheet width direction W and a second direction opposite to the first direction. The post-processing controller 24 can shift the printed matter in the first direction and the second direction by performing the horizontal alignment of the printed matter.

As shown in FIG. 4, a placement position of the printed matter before the horizontal alignment is performed is set as a reference position Pc. The reference position Pc is a position where a position of the center between the first horizontal alignment plate 71 and the second horizontal alignment plate 72 in the sheet width direction W coincides with the center line CL of the printed matter. The reference position Pc is a position where a position of the center of the processing tray 50 (refer to FIG. 3) in the sheet width direction W coincides with the center line CL of the printed matter. The reference position Pc is a center reference position of the processing tray 50 in the sheet width direction W.

As shown in FIG. 6, the first horizontal alignment plate 71 moves in an arrow K1 direction, and in this way, the printed matter is shifted towards a first direction K1. The first direction K1 corresponds to a front direction of a main body of the MFP. With the second horizontal alignment plate 72 at the fixed position, the first horizontal alignment plate 71 moves in the arrow K1 direction. Due to the approach of the first horizontal alignment plate 71 and the second horizontal alignment plate 72, the horizontal alignment mechanism 70 performs the horizontal alignment while shifting the printed matter in the first direction K1.

As shown in FIG. 7, the second horizontal alignment plate 72 moves in an arrow K2 direction, and in this way, the printed matter is shifted towards a second direction K2. The second direction K2 corresponds to a rear direction (the direction opposite to the front direction) of the main body of the MFP. With the first horizontal alignment plate 71 at the fixed position, the second horizontal alignment plate 72 moves in the arrow K2 direction. Due to the approach of the first horizontal alignment plate 71 and the second horizontal alignment plate 72, the horizontal alignment mechanism 70 performs the horizontal alignment while shifting the printed matter in the second direction K2.

Next, an example of a method of controlling the shift operation in some embodiments is described.

Figure 8:
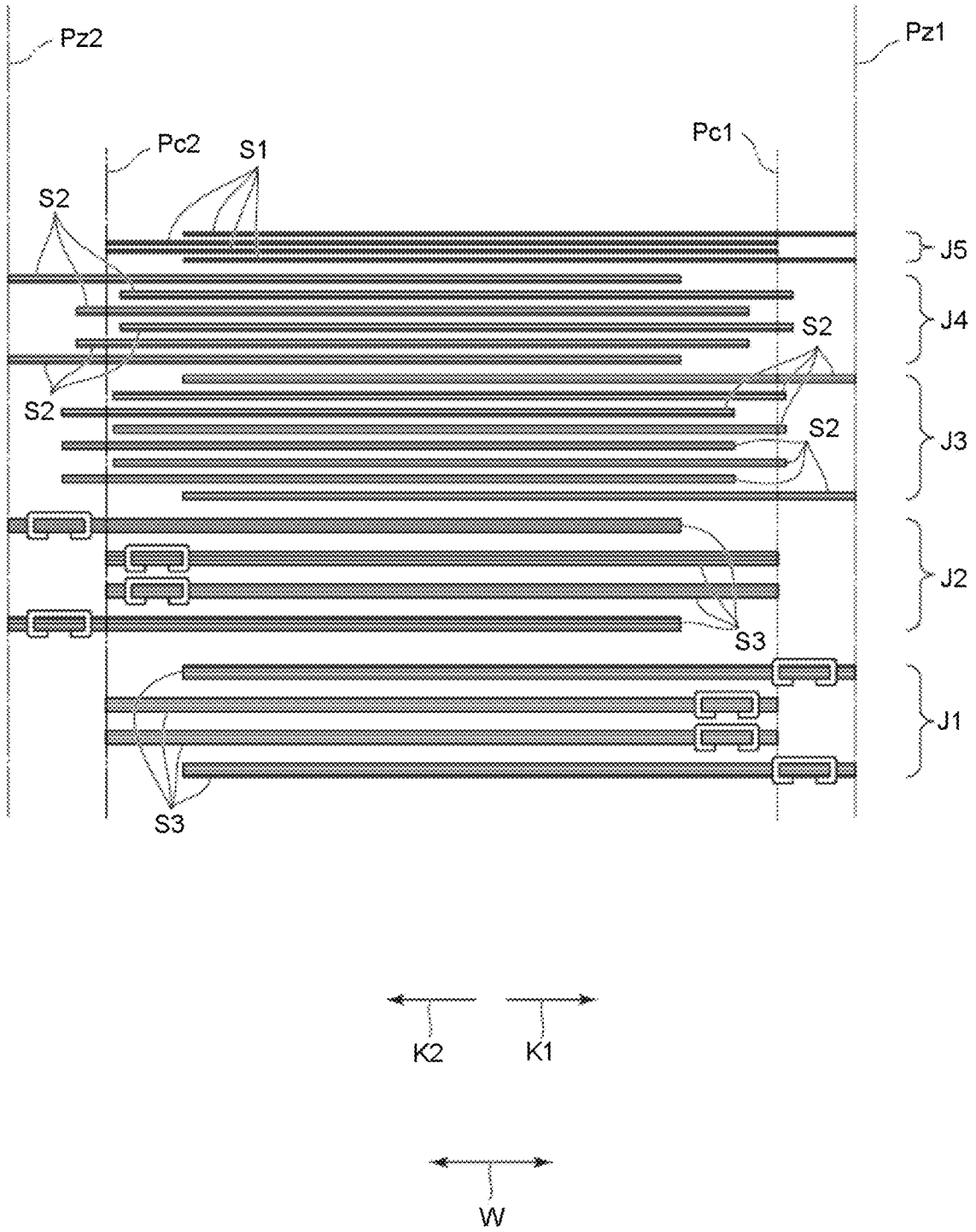
FIG. 8 is a diagram illustrating an example of a stacked state of printed matter according to at least one embodiment.

FIG. 8 is a diagram illustrating an example of a stacked state of the printed matter according to some embodiments. In FIG. 8, illustration of the sheet discharge tray is omitted. FIG. 8 is a diagram as viewed from a conveyance direction (discharge direction to the sheet discharge tray) of the printed matter.

The post-processing controller 24 executes a printing processing on each job which is a printing unit based on one printing request. The post-processing controller 24 executes a plurality of jobs according to a request instruction from a user. In the example in FIG. 8, the stacked state of the printed matter by five jobs is shown. The five jobs are a first job J1, a second job J2, a third job J3, a fourth job J4, and a fifth job J5. The post-processing controller 24 executes a processing according to the first job J1, the second job J2, the third job J3, the fourth job J4, and the fifth job J5 in order. The printed matter are discharged to the sheet discharge tray in the order of the first job J1, the second job J2, the third job J3, the fourth job J4, and the fifth job J5.

Hereinafter, a sheet bundle subjected to the sorting processing is also referred to as a "sorted sheet bundle" and a sheet bundle subjected to the stapling processing is also referred to as a "stapled sheet bundle". The sorted sheet bundle is not subjected to the stapling processing. In FIG. 8, the sheet is denoted with a reference numeral S1, the sorted sheet bundle is denoted with a reference numeral S2, and the stapled sheet bundle is denoted with a reference numeral S3.

The post-processing controller 24 controls the horizontal alignment mechanism 70 to divide the printed matter in the first direction K1 and the second direction K2.

The post-processing controller 24 controls the horizontal alignment mechanism 70 to shift a first part and the last part of the plurality of the stapled sheet bundles S3 towards the first direction K1 in the first job J1. The stapler of the sheet bundle S3 in the first job J1 is positioned at an outer end in the first direction K1 of the stapled sheet bundle S3. In FIG. 8, a reference numeral Pz1 indicates a shift position in the first direction K1 (hereinafter, also referred to as a "first shift position"). The first shift position Pz1 is the outermost end position in the first direction K1 of the printed matter shifted towards the first direction K1.

The post-processing controller 24 does not perform the shift position on a middle part (a part except the first part and the last part) between the first part and the last part of the plurality of the stapled sheet bundles S3 in the first job J1. The post-processing controller 24 discharges the middle part of the plurality of the stapled sheet bundles S3 to the reference position of the sheet discharge tray (hereinafter, referred to as "sheet discharge reference position") in the first job J1. In the sheet width direction W, the sheet discharge reference position is substantially the same as the reference position Pc (refer to FIG. 4) of the processing tray 50. In FIG. 8, a reference numeral Pc1 indicates the outermost end position in the first direction K1 of the printed matter positioned at the sheet discharge reference position, and a reference numeral Pc2 indicates the outermost end position in the second direction K2 of the printed matter positioned at the sheet discharge reference position.

The post-processing controller 24 controls the horizontal alignment mechanism 70 to shift the first part and the last part of the plurality of the stapled sheet bundles S3 towards the second direction K2 in the second job J2. The stapler of the sheet bundle S3 in the second job J2 is positioned at the outer end in the second direction K2 of the stapled sheet bundle S3. In FIG. 8, the reference numeral Pz2 indicates a shift position towards the second direction K2 (hereinafter, also referred to as a "second shift position"). The second shift position Pz2 is the outermost end position in the second direction K2 of the printed matter shifted towards the second direction K2.

The post-processing controller 24 does not perform the shift position on a middle part (a part except the first part and the last part) between the first part and the last part of the plurality of the stapled sheet bundles S3 in the second job J2. The post-processing controller 24 discharges the middle part of the plurality of the stapled sheet bundles S3 to the sheet discharge reference position in the second job J2.

The post-processing controller 24 controls the horizontal alignment mechanism 70 to shift the first part and the last part of the sorted sheet bundle S2 towards the first direction K1 in the third job J3. In the third job J3, the post-processing controller 24 discharges the middle part (a part except the first part and the last part) between the first part and the last part of the plurality of the sorted sheet bundles S2 to a position close to the sheet discharge reference position. In the third job J3, the plurality of the sorted sheet bundles S2 is discharged in such a manner that the positions of respective parts are shifted to be different from each other in the sheet width direction W. In the third job J3, the outermost end position in the sheet width direction W of the middle part of the plurality of the sorted sheet bundles S2 is offset with respect to the positions Pc1 and Pc2.

The post-processing controller 24 controls the horizontal alignment mechanism 70 to shift the first part and the last part of the plurality of the sorted sheet bundles S2 towards the second direction K2 in the fourth job J4. In the fourth job J4, the post-processing controller 24 discharges a middle part (a part except the first part and a last part) between the first part and the last part of the plurality of the sorted sheet bundle S2 to a position close to the sheet discharge reference position. In the fourth job J4, the plurality of the sorted sheet bundles S2 is discharged in such a manner that the positions of respective parts are shifted to be different from each other in the sheet width direction W. In the fourth job J4, the outermost end position in the sheet width direction W of the middle part of the plurality of the sorted sheet bundles S2 is offset with respect to the positions Pc1 and Pc2.

The post-processing controller 24 controls the horizontal alignment mechanism 70 to shift the first sheet and the last sheet among a plurality of sheets S1 towards the first direction K1 in the fifth job J5. In the fifth job J5, the post-processing controller 24 discharges the middle part (a part except the first sheet and the last sheet) between the first sheet and the last sheet of a plurality of the sheets S1 to the sheet discharge reference position.

The post-processing controller 24 controls the horizontal alignment mechanism 70 to shift the first sheet or the first part and the last sheet or the last part towards the first direction K1 in a (2n−1) job (n is an integer). The post-processing controller 24 controls the horizontal alignment mechanism 70 to shift the first sheet or the first part and the last sheet or the last part towards the second direction K2 in a 2n job.

The post-processing controller 24 controls the shift operation towards the first direction K1 in the odd-numbered job. The post-processing controller 24 controls the shift operation towards the second direction K2 in the even-numbered job. The post-processing controller 24 makes the shift direction of the printed matter different between the odd-numbered job and the even-numbered job.

The post-processing controller 24 sets a shift amount of the printed matter towards the first direction K1 or the second direction K2 from the sheet discharge reference position by taking a shift in the conveyance (shift in sheet discharge) of the printed matter into account. For example, the post-processing controller 24 sets the shift amount of the printed matter to be greater than the maximum shift amount in the conveyance of the printed matter. The post-processing controller 24 calculates the maximum value of the shift in the conveyance of the printed matter based on a detection result of a position sensor (not shown).

According to some embodiments, the post-processing apparatus 3 has the movable tray 23*b*, the horizontal alignment mechanism 70, and the post-processing controller 24. The printed matter is discharged to the movable tray 23*b*. The horizontal alignment mechanism 70 can shift the discharge position of the printed matter discharged to the movable tray 23*b* from the sheet discharge reference position. The post-processing controller 24 controls the horizontal alignment mechanism 70. The post-processing controller 24 divides the printed matter in the first direction K1 in the sheet width direction W and the second direction K2 opposite to the first direction K1. With the above configuration, the following effects are achieved. The printed matter discharged to the movable tray 23*b* are divided in the first direction K1 and the second direction K2 in the sheet width direction W, and in this way, a difference in the shift amount of the printed matter occurs on the movable tray 23*b*. The difference in the shift amount of the printed matter becomes greater than that in a case in which the printed matter are shifted only in either the first direction K1 or the second direction K2 in the sheet width direction W, thereby making the boundary between the printed matter easy to recognize. Therefore, the printed matter can be easily taken out.

The post-processing controller 24 executes the first job J1 which is a printing unit based on the first printing request and the second job J2 which is a printing unit based on a second printing request. The post-processing controller 24 controls the horizontal alignment mechanism 70. The post-processing controller 24 shifts the first sheet or the first part and the last sheet or the last part towards the first direction K1 in the first job J1. The post-processing controller 24 shifts the first sheet or the first part and the last sheet or the last part towards the second direction K2 in the second job J2. With the above configuration, the following effects are achieved. Since the shift directions of the printed matter are different in the first job J1 and the second job J2, a difference in the shift amount of the printed matter is generated between the jobs. The different in the shift amount of the printed matter is greater than that in a case in which the shift directions of the printed matter are the same both in the first job J1 and in the second job J2, thereby making the boundary between the printed matter easy to recognize. Therefore, the printed matter can be easily taken out. In addition, even if the printed matter for plural users are mixed on the movable tray 23*b*, since the boundary between the printed matter is easy to recognize, the printed matter can be easily taken out.

Modifications are described below.

First, a first modification of some embodiments is described.

In the second job J2, it is not limited to shifting the first part and the last part of a plurality of the stapled sheet bundles S3 towards the second direction K2.

Figure 9:
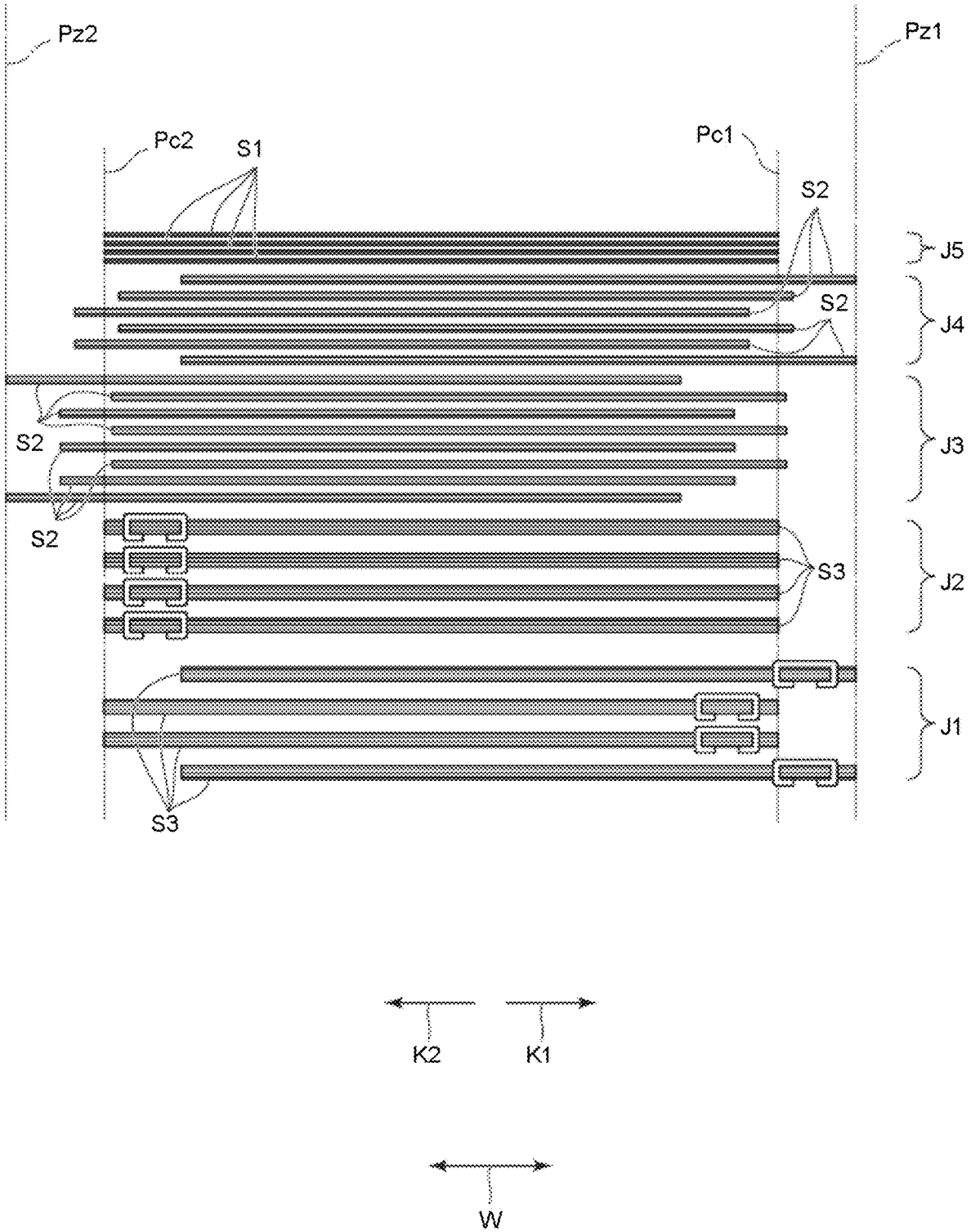
FIG. 9 is a diagram illustrating a stacked state of printed matter according to a first modification of some embodiments.

FIG. 9 is a diagram illustrating the stacked state of the printed matter according to the first modification of some embodiments. FIG. 9 corresponds to FIG. 8.

As shown in FIG. 9, in the first job J1, the first part and the last part of the plurality of the stapled sheet bundles S3 are shifted towards the first direction K1. In the first job J1, the middle part of the plurality of the stapled sheet bundles S3 is discharged to the sheet discharge reference position.

In the second job J2, the first part and the last part of the plurality of the stapled sheet bundles S3 may be discharged to the sheet discharge reference position. In the second job J2, each of the plurality of the stapled sheet bundles S3 may be discharged to the sheet discharge reference position.

In the third job J3, the first part and the last part of the plurality of the sorted sheet bundles S2 may be shifted towards the second direction K2. In the third job J3, the middle part of the plurality of the sorted sheet bundles S2 may be discharged to a position close to the sheet discharge reference position. In the third job J3, the plurality of the sorted sheet bundles S2 may be discharged in such a manner that the positions of respective parts are shifted to be different from each other in the sheet width direction W. In the third job J3, the outermost end position in the sheet width direction W of the middle part of the plurality of the sorted sheet bundles S2 may be offset with respect to the positions Pc1 and Pc2.

In the fourth job J4, the first part and the last part of the plurality of the sorted sheet bundles S2 may be shifted towards the first direction K1. In the fourth job J4, the middle part of the plurality of the sorted sheet bundles S2 may be discharged to the position close to the sheet discharge reference position. In the fourth job J4, the plurality of the sorted sheet bundles S2 may be discharged in such a manner that the positions of respective parts are shifted to be different from each other in the sheet width direction W. In the fourth job J4, the outermost end position in the sheet width direction W of the middle part of the plurality of the sorted sheet bundles S2 may be offset with respect to the positions Pc1 and Pc2.

In the fifth job J5, the first sheet and the last sheet of the plurality of the sheets S1 may be discharged to the sheet discharge reference position. In the fifth job J5, each of the plurality of the sheets S1 may be discharged to the sheet discharge reference position.

In the first job, the first sheet or the first part and the last sheet or the last part may be shifted towards the first direction K1. In the second job, the first sheet or the first part and the last sheet or the last part may be discharged to the sheet discharge reference position. In the third job, the first sheet or the first part and the last sheet or the last part may be shifted towards the second direction K2.

The post-processing controller 24 controls the shift operation towards the first direction K1 in the first job. The post-processing controller 24 does not necessarily control the shift operation in the second job. The post-processing controller 24 may control the shift operation towards the second direction K2 in the third job. The post-processing controller 24 may also make the shift directions of the printed matter different from each other through a job in which the shift operation is not controlled.

According to the first modification, the post-processing controller 24 executes the first job J1, the second job J2, and the third job J3 in the order of the first job J1, the second job J2, and the third job J3. The post-processing controller 24 controls the horizontal alignment mechanism 70. The post-processing controller 24 shifts the first sheet or the first part and the last sheet or the last part towards the first direction K1 in the first job J1. The post-processing controller 24 discharges the first sheet or the first part and the last sheet or the last part to the sheet discharge reference position in the second job J2. The post-processing controller 24 shifts the first sheet or the first part and the last sheet or the last part towards the second direction K2 in the third job J3. With the above configuration, the following effects are achieved. Since the shift directions of the printed matter are different between the first job J1 and the third job J3 interposed by the second job J2, a difference in the shift amount of the printed matter is generated between the jobs. The difference in the shift amount of the printed matter becomes large when compared with a case in which the shift directions of the printed matter are the same in the first job J1 to the third job J3, thereby making the boundary between the printed matter easy to recognize. Therefore, the printed matter can be easily taken out. In addition, even if the printed matter for plural users are mixed on the movable tray 23*b*, since the boundary between the printed matter is easy to recognize, the printed matter can be easily taken out.

Next, a second modification of some embodiments is described.

In the first job J1, it is not limited to shifting the first part and the last part of a plurality of the stapled sheet bundles S3 towards the first direction K1.

Figure 10:
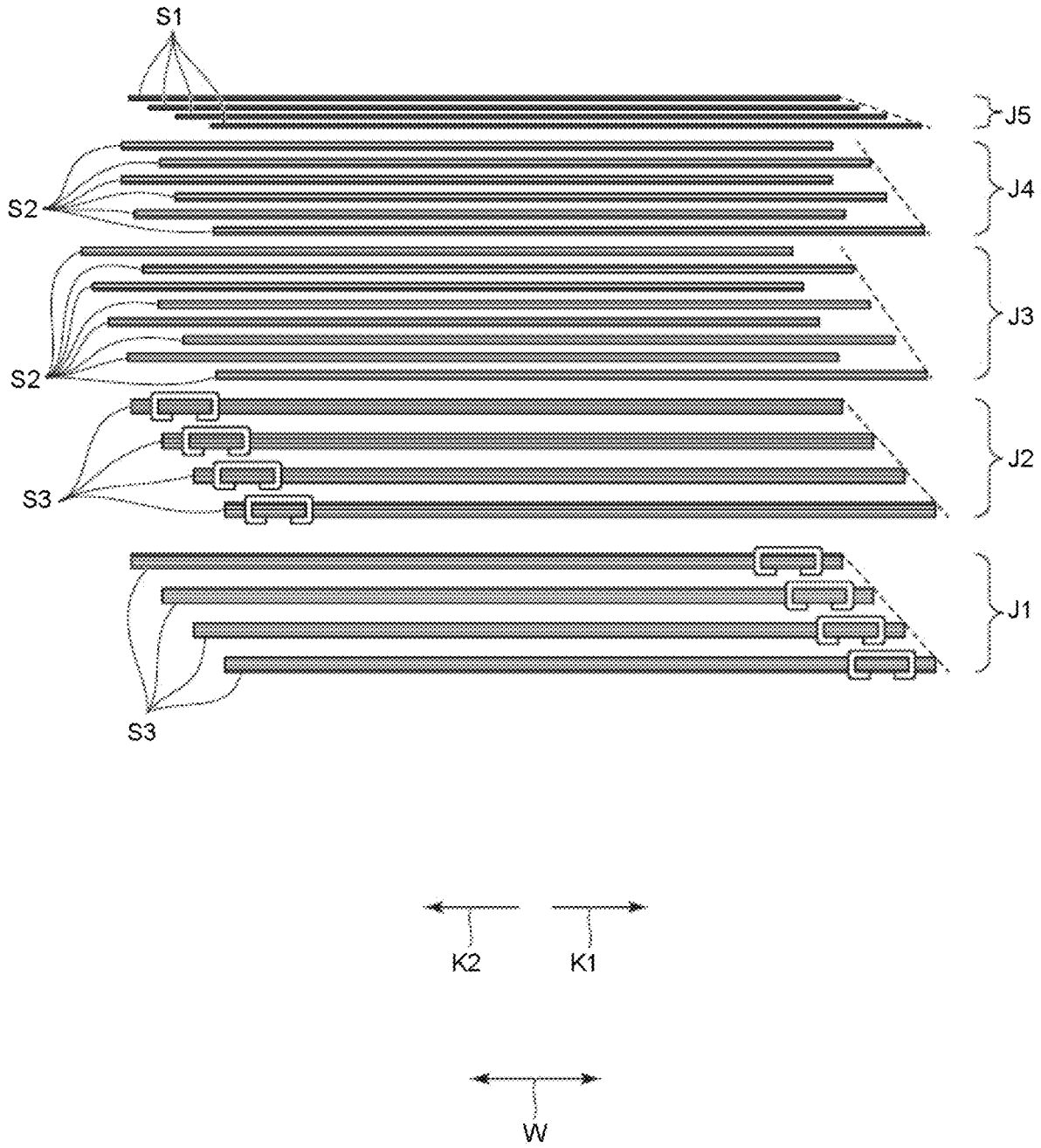
FIG. 10 is a diagram illustrating a stacked state of printed matter according to a second modification of some embodiments.

FIG. 10 is a diagram illustrating the stacked state of the printed matter according to the second modification of some embodiments. FIG. 10 corresponds to FIG. 8.

As shown in FIG. 10, the post-processing controller 24 may control the horizontal alignment mechanism 70 to change a shift amount from the sheet discharge reference position of the printed matter as the number of placed printed matter discharged to the sheet discharge tray (not shown) increases. The post-processing controller 24 may control the horizontal alignment mechanism 70 to stack the printed matter obliquely as viewed from the conveyance direction of the printed matter.

The post-processing controller 24 may gradually reduce the shift amount towards the first direction K1 as the number of the stapled sheet bundles S3 increases in both the first job J1 and the second job J2. In both the first job J1 and the second job J2, a virtual line (broken line) connecting the outermost ends in the first direction K1 of a plurality of the stapled sheet bundles S3 may be inclined to be positioned closer to the sheet discharge reference position at the upper side.

The post-processing controller 24 may gradually reduce the shift amount towards the first direction K1 as the number of the sorted sheet bundles S2 increases in both the third job J3 and the fourth job J4. In both the third job J3 and the fourth job J4, a virtual line (broken line) connecting the outermost ends in the first direction K1 of a plurality of the sorted sheet bundles S2 may be inclined to be positioned closer to the sheet discharge reference position at the upper side.

In the fifth job J5, the post-processing controller 24 may gradually reduce the shift amount towards the first direction K1 as the number of the sheets S1 increases. In the fifth job J5, a virtual line (broken line) connecting the outermost ends in the first direction K1 of a plurality of the sheets S1 may be inclined to be positioned closer to the sheet discharge reference position at the upper side.

The post-processing controller 24 may gradually reduce the shift amount towards the first direction K1 along with the increase in the number of the printed matter in each of the jobs J1 to J5. In each of the jobs J1 to J5, only the outer ends of the plurality of the printed matter in the first direction K1 may be inclined as viewed from the conveyance direction of the printed matter.

According to the second modification, the post-processing controller 24 controls the horizontal alignment mechanism 70 to change the shift amount from the sheet discharge reference position of the printed matter as the number of placed printed matter discharged to the sheet discharge tray increases. The post-processing controller 24 controls the horizontal alignment mechanism 70 to stack the printed matter obliquely as viewed from the conveyance direction of the printed matter. With the above configuration, the following effects are achieved. The printed matter discharged to the sheet discharge tray are stacked obliquely as viewed from the conveyance direction, and in this way, the difference in the shift amount of the printed matter on the sheet discharge tray occurs, thereby making the boundary between the printed matter easy to recognize. Therefore, the printed matter can be easily taken out.

In each of the jobs J1 to J5, by inclining only the outer ends of the plurality of the printed matter in the first direction K1 as viewed from the conveyance direction of the printed matter, the following effects are achieved. If the post-processing apparatus 3 has an in-body sheet discharge tray in a housing of the post-processing apparatus 3, the printed matter may be discharged to the in-body sheet discharge tray in some cases. It may be difficult to visually recognize the printed matter on the in-body sheet discharge tray from the second direction K2 due to a back wall (rear wall) of the housing or the like in some cases. According to the present modification, in each of the jobs J1 to J5, the difference in the shift amount of the printed matter occurs at the outer ends in the first direction K1 of the plurality of the printed matter, so that the boundary of the printed matter is easy to recognize when visually recognizing the printed matter from the first direction K1. Therefore, even when it is difficult to visually recognize the printed matter on the in-body sheet discharge tray from the second direction K2, the printed matter can be easily taken out.

Next, a third modification of some embodiments is described.

In each of the jobs J1 to J5, it is not limited to inclining only the outer ends in the first direction K1 of the plurality of the printed matter as viewed from the conveyance direction of the printed matter.

Figure 11:
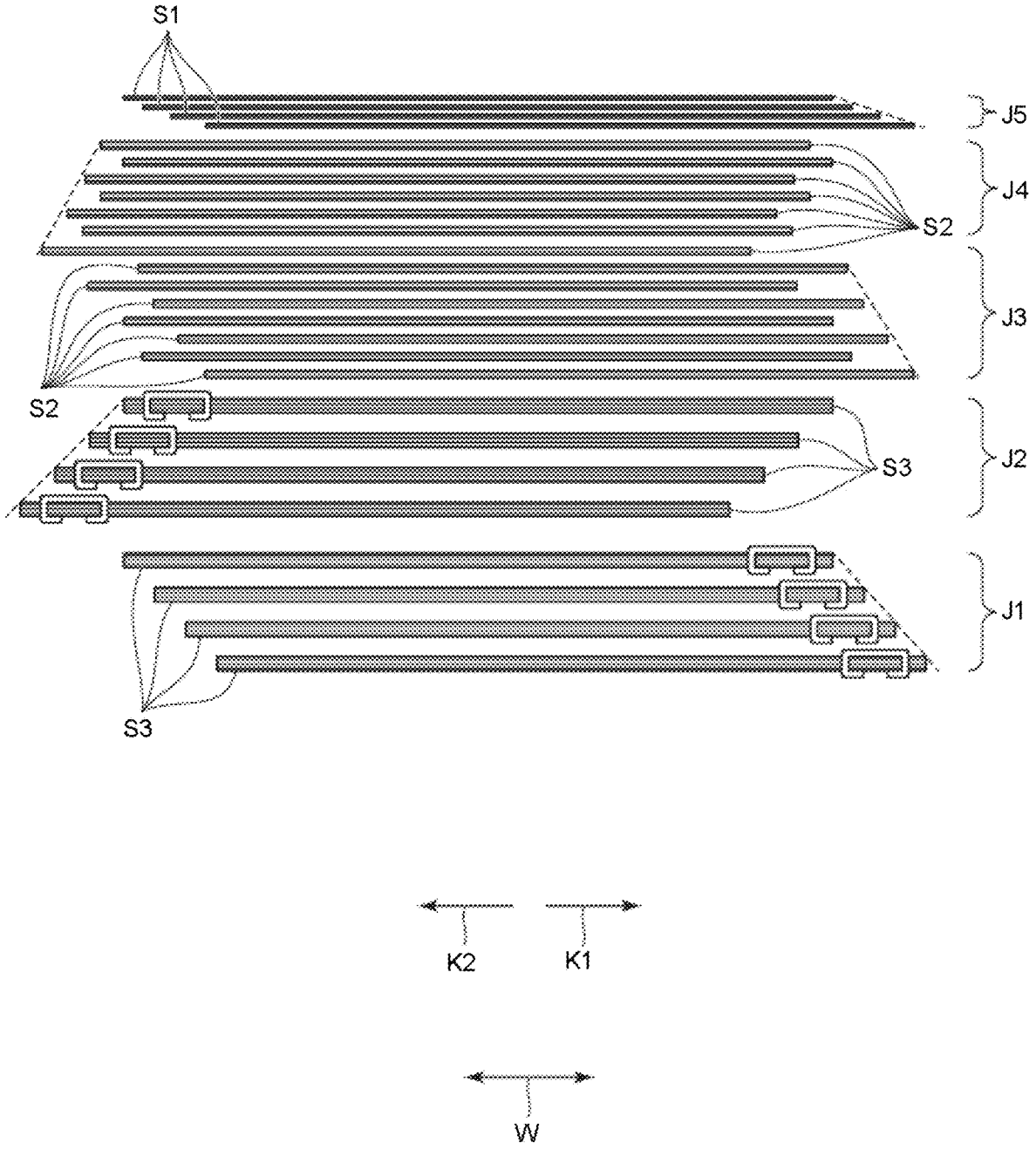
FIG. 11 is a diagram illustrating a stacked state of printed matter according to a third modification of some embodiments.

FIG. 11 is a diagram illustrating the stacked state of the printed matter according to the third modification of some embodiments. FIG. 11 corresponds to FIG. 8.

As shown in FIG. 11, in the first job J1, as the number of the printed matter increases, the post-processing controller 24 may change the shift amount towards the first direction K1 to stack the printed matter obliquely as viewed from the conveyance direction. In the second job J2, as the number of the printed matter increases, the post-processing controller 24 may change the shift amount towards the second direction K2 opposite to the first direction K1 to stack the printed matter obliquely as viewed from the conveyance direction.

In each of the first job J1, the third job J3 and the fifth job J5, as the number of the printed matter increases, the post-processing controller 24 may gradually reduce the shift amount towards the first direction K1. In each of the first job J1, the third job J3 and the fifth job J5, a virtual line (broken line) connecting the outermost ends in the first direction K1 of a plurality of the printed matter may be inclined to be positioned closer to the sheet discharge reference position at the upper side.

The post-processing controller 24 may gradually reduce the shift amount towards the second direction K2 as the number of the printed matter increases in both the second job J2 and the fourth job J4. In both the second job J2 and the fourth job J4, a virtual line (broken line) connecting the outermost ends in the second direction K2 of a plurality of the printed matter may be inclined to be positioned closer to the sheet discharge reference position at the upper side.

In the (2n−1) job, the shift amount towards the first direction K1 may be gradually reduced with the number of the printed matter increases. In the 2n job, the shift amount towards the second direction K2 may be gradually reduced with the number of the printed matter increasing.

According to the third modification, the post-processing controller 24 changes the shift amount towards the first direction K1 as the number of the printed matter increases to stack the printed matter obliquely as viewed from the conveyance direction in the first job J1. In the second job J2, as the number of the printed matter increases, the post-processing controller 24 may change the shift amount towards the second direction K2 opposite to the first direction K1 to stack the printed matter obliquely as viewed from the conveyance direction. With the above configuration, the following effects are achieved. The directions in which the shift amount of the printed matter is changed are different from each other between the first job J1 and the second job J2, thereby making the boundary between the printed matter easy to recognize when viewed from the conveyance direction of the printed matter. Therefore, the printed matter can be easily taken out. In addition, even if the printed matter for plural users are mixed on the sheet discharge tray, since the boundary between the printed matter is easy to recognize, the printed matter can be easily taken out.

The post-processing controller 24 may gradually reduce the shift amount towards the first direction K1 as the number of the printed matter increases in the first job J1. The post-processing controller 24 may gradually reduce the shift amount towards the second direction K2 as the number of the printed matter increases in the second job J2. With the above configuration, the following effects are achieved. In the both first job J1 and the second job J2, a virtual line (broken line) connecting the outermost ends in the sheet width direction W of a plurality of the printed matter may be inclined to be positioned closer to the sheet discharge reference position at the upper side. Since the outermost ends of the printed matter in each job are inclined, the printing unit (a printing output) for each job becomes easy to recognize. Therefore, the printed matter for each job can be easily taken out.

Next, a fourth modification of some embodiments is described.

The degrees of inclination of virtual lines connecting the outermost ends in the sheet width direction W of a plurality of the printed matter in each of the jobs is not limited to be the same.

Figure 12:
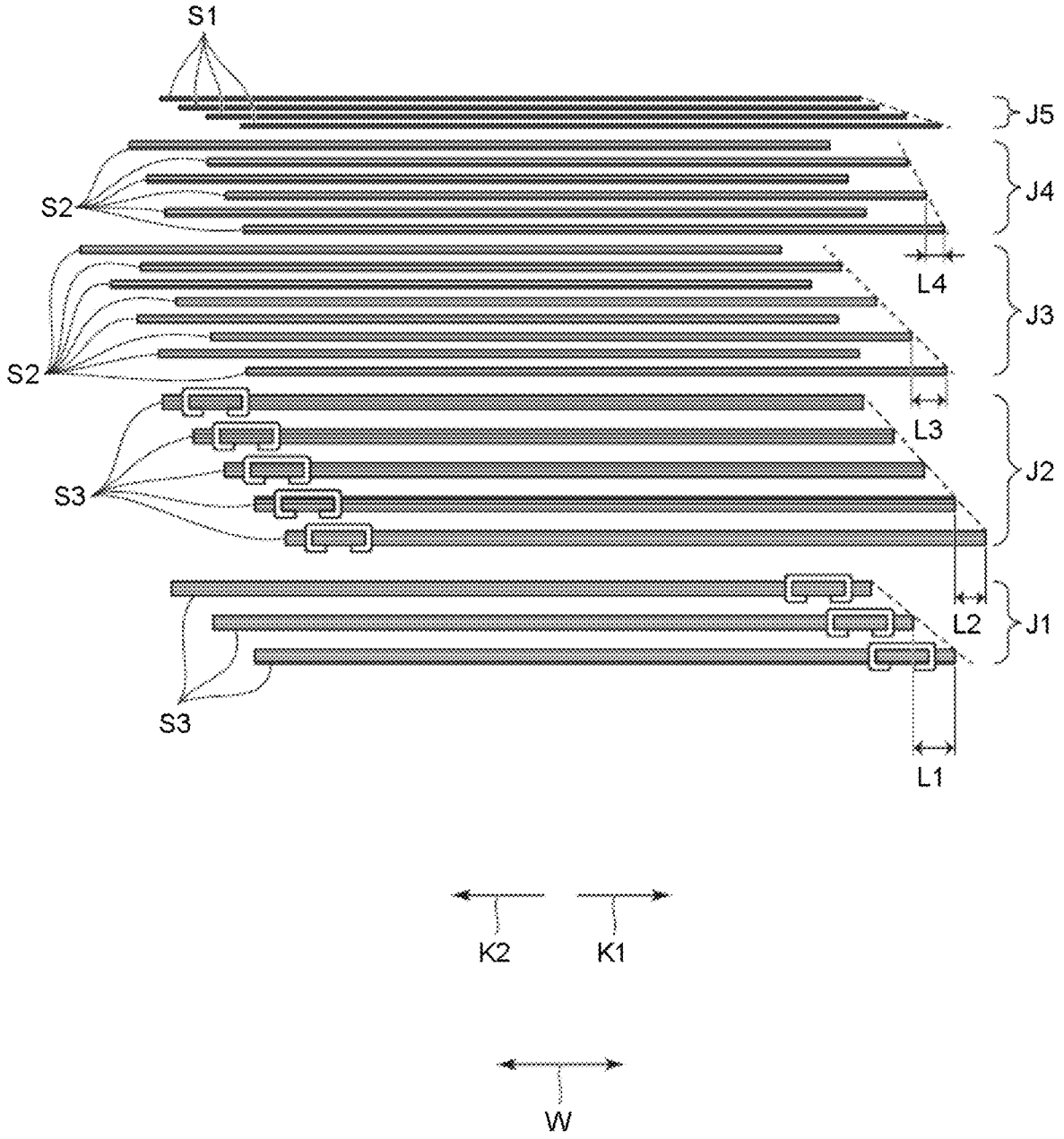
FIG. 12 is a diagram illustrating a stacked state of printed matter according to a fourth modification of some embodiments.

FIG. 12 is a diagram illustrating the stacked state of the printed matter according to the fourth modification of some embodiments. FIG. 12 corresponds to FIG. 8.

As shown in FIG. 12, when the number of placed printed matter is smaller than a threshold value, the post-processing controller 24 may set the shift amount towards the sheet width direction W to be greater than the shift amount when the number of placed printed matter is equal to or greater than the threshold value. When the number of placed printed matter is greater than the threshold value, the post-processing controller 24 may set the shift amount towards the sheet width direction W to be greater than the shift amount when the number of placed printed matter is equal to or smaller than the threshold value. In FIG. 12, shift amount L1 to L4 mean offset amount in the sheet width direction W of two adjacent printed matter in the stacked direction of the printed matter.

In the example in FIG. 12, the number of the stapled sheet bundles S3 in the first job J1 is 3, and the number of the stapled sheet bundles S3 in the second job J2 is 5. The threshold value of the number of the stapled sheet bundles S3 is 4. The number of the stapled sheet bundles S3 in the first job J1 is smaller than the threshold value. The number of the stapled sheet bundles S3 in the second job J2 is equal to or greater than the threshold value. The post-processing controller 24 may set the shift amount L1 towards the first direction K1 of the stapled sheet bundle S3 in the first job J1 to be greater than the shift amount L2 towards the first direction K1 of the stapled sheet bundle S3 in the second job J2 (L1>L2). The degree of inclination of the virtual line (broken line) in the first job J1 may be smaller than the degree of inclination of the virtual line (broken line) in the second job J2.

In the example in FIG. 12, the number of the sorted sheet bundles S2 in the third job J3 is 8, and the number of the sorted sheet bundles S2 in the fourth job J4 is 6. The threshold value of the number of the sorted sheet bundles S2 is 7. The number of the sorted sheet bundles S2 in the third job J3 is greater than the threshold value. The number of the sorted sheet bundles S2 in the fourth job J4 is equal to or smaller than the threshold value. The post-processing controller 24 may set the shift amount L3 towards the first direction K1 of the sorted sheet bundle S2 in the third job J3 to be greater than the shift amount L4 towards the first direction K1 of the sorted sheet bundle S2 in the fourth job J4 (L3>L4). The degree of inclination of the virtual line (broken line) in the third job J3 may be smaller than the degree of inclination of the virtual line (broken line) in the fourth job J4.

According to the fourth modification, when the number of placed printed matter is smaller than the threshold value, the post-processing controller 24 may set the shift amount towards the sheet width direction W to be greater than the shift amount when the number of placed printed matter is equal to or greater than the threshold value. When the number of placed printed matter is greater than the threshold value, the post-processing controller 24 may set the shift amount towards the sheet width direction W to be greater than the shift amount when the number of placed printed matter is equal to or smaller than the threshold value. With the above configuration, the following effects are achieved. In each of the jobs, the degrees of inclination of the virtual lines connecting the outermost ends of the plurality of the printed matter in the sheet width direction W are different from each other, thereby making the boundary between the printed matter easy to recognize. Therefore, the printed matter can be easily taken out.

Next, a fifth modification of some embodiments is described.

In each of the jobs J1 to J5, it is not limited to inclining only the outer ends of the plurality of the printed matter in the first direction K1 as viewed from the conveyance direction of the printed matter.

Figure 13:
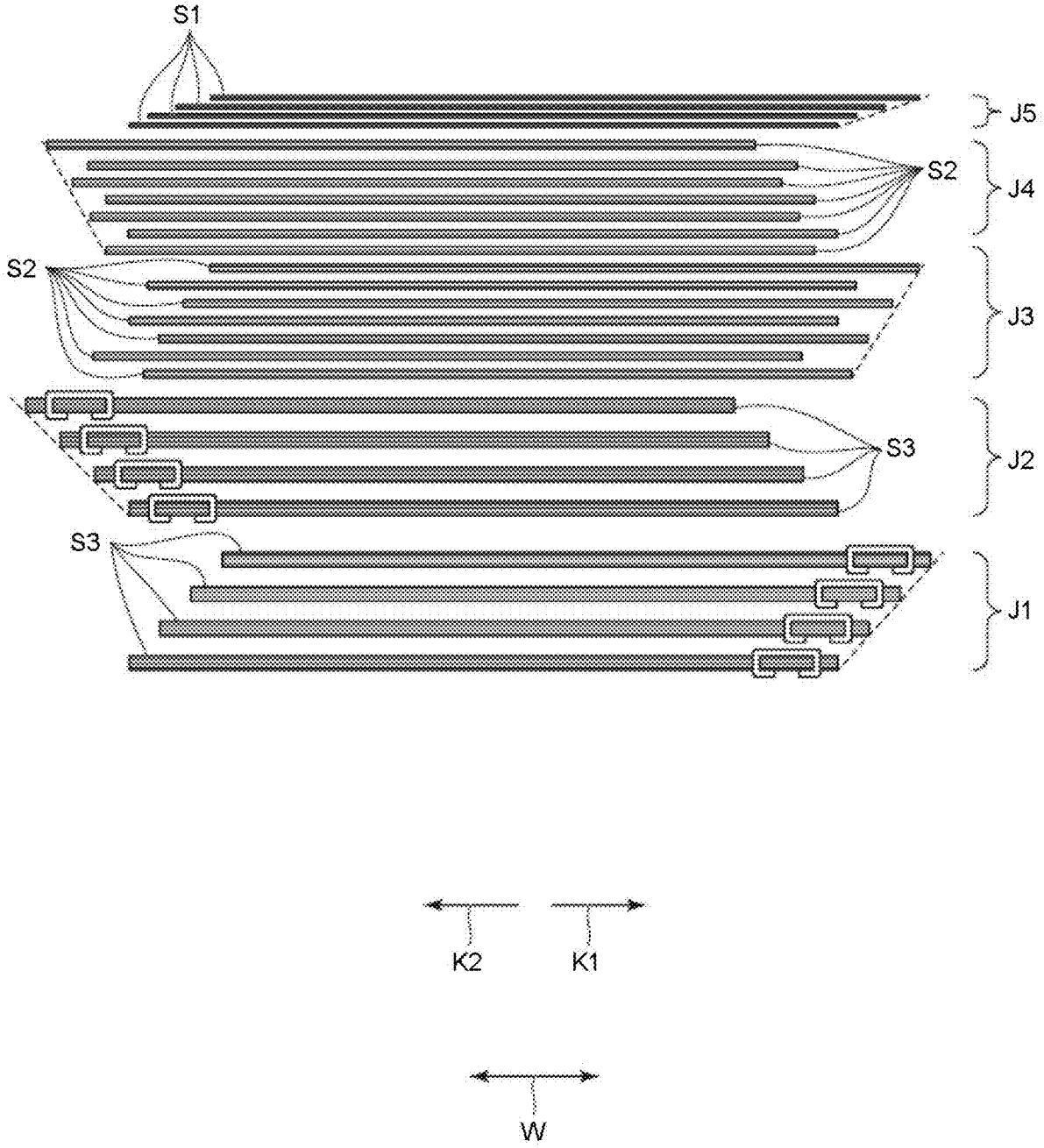
FIG. 13 is a diagram illustrating a stacked state of printed matter according to a fifth modification of some embodiments.

FIG. 13 is a diagram illustrating the stacked state of the printed matter according to the fifth modification of some embodiments. FIG. 13 corresponds to FIG. 8.

As shown in FIG. 13, in each of the first job J1, the third job J3 and the fifth job J5, as the number of the printed matter increases, the post-processing controller 24 may generally increase the shift amount towards the first direction K1. In each of the first job J1, the third job J3 and the fifth job J5, a virtual line (broken line) connecting the outermost ends in the first direction K1 of a plurality of the printed matter may be inclined to be positioned farther from the sheet discharge reference position at the upper side.

The post-processing controller 24 may gradually increase the shift amount towards the second direction K2 as the number of the printed matter increases in both the second job J2 and the fourth job J4. In both the second job J2 and the fourth job J4, a virtual line (broken line) connecting the outermost ends in the second direction K2 of a plurality of the printed matter may be inclined to be positioned farther from the sheet discharge reference position at the upper side.

In the (2n−1) job, the shift amount towards the first direction K1 may be gradually increased with the number of the printed matter increasing. In the 2n job, the shift amount towards the second direction K2 may be gradually increased with the number of the printed matter increasing.

According to the fifth modification, the post-processing controller 24 gradually increase the shift amount towards the first direction K1 as the number of the printed matter increases in the first job J1. In the second job J2, as the number of the printed matter increases, the post-processing controller 24 may gradually increase the shift amount towards the second direction K2. With the above configuration, the following effects are achieved. The virtual line (broken line) connecting the outermost ends in the sheet width direction W of the plurality of the printed matter are inclined to be positioned farther from the sheet discharge reference position at the upper side both in the first job J1 and in the second job J2. Since the outermost ends of the printed matter are inclined in each job, the printing unit in each job is easy to recognize. Therefore, the printed matter in each job can be easily taken out.

Next, other modifications of some embodiments are described.

The reference position Pc of the processing tray 50 is not limited to the center reference position of the processing tray 50 in the sheet width direction W. For example, the reference position of the processing tray 50 may be a side reference position of the processing tray 50 in the sheet width direction W. For example, the reference position of the processing tray 50 may be an installation position of the first horizontal alignment plate 71 or the second horizontal alignment plate 72.

The shift operation of the printed matter is not limited to being performed through approach or separation between the first horizontal alignment plate 71 and the second horizontal alignment plate 72. For example, the shift operation of the printed matter may be realized by a configuration provided with a first tray and a second tray on which the printed matter can be placed before the printed matter is discharged to the sheet discharge tray. For example, the shift operation of the printed matter may be performed by controlling a rotation timing of the first tray and a rotation timing of the second tray.

The shift operation of the printed matter is not limited to being performed in each of a plurality of jobs. For example, the shift operation of the printed matter may be performed in one job.

It is not limited to processing a plurality of printed matter in one job. For example, only one printed matter may be processed in one job.

The object of the shift operation of the first job J1 and the second job J2 is not limited to being the stapled sheet bundle S3. For example, the object of the shift operation of the first job J1 and the second job J2 may be the sorted sheet bundle S2 or the sheet S1. The object of the shift operation in each job may be arbitrarily set based on the request command of the user.

According to at least one embodiment described above, the post-processing apparatus 3 has the movable tray 23*b*, the horizontal alignment mechanism 70, and the post-processing controller 24. The printed matter is discharged to the movable tray 23*b*. The horizontal alignment mechanism 70 can shift the discharge position of the printed matter discharged to the movable tray 23*b* from the sheet discharge reference position. The post-processing controller 24 controls the horizontal alignment mechanism 70. The post-processing controller 24 divides the printed matter in the first direction K1 in the sheet width direction W and the second direction K2 opposite to the first direction K1. With the above configuration, the following effects are achieved. The printed matter discharged to the movable tray 23*b* are divided in the first direction K1 and the second direction K2 in the sheet width direction W so that the difference in the shift amount of the printed matter on the movable tray 23*b* occurs. The difference in the shift amount of the printed matter becomes greater than that in a case in which the printed matter are shifted only in either the first direction K1 or the second direction K2 in the sheet width direction W, thereby making the boundary between the printed matter easy to recognize. Therefore, the printed matter can be easily taken out.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of some embodiments described herein may be made without departing from the spirit of the inventions. The accompanying claims and there equivalents are intended to cover such forms or modifications as would fall within the scope and spirit of the invention.

What is claimed is:

1. A post-processing apparatus, comprising:

a sheet discharge tray to which a sheet or a sheet bundle is discharged;

a shift mechanism configured to shift a discharge position of the sheet or the sheet bundle discharged to the sheet discharge tray from a reference position; and a controller configured to control the shift mechanism to divide the sheet or the sheet bundle in a first direction in a direction orthogonal to a conveyance direction of the sheet or the sheet bundle and a second direction opposite to the first direction, control the shift mechanism to shift the sheet bundle for each job of a plurality of jobs, and when a job includes a plurality of sheet bundles, control the shift mechanism to shift more than one bundle of the plurality of sheet bundles included in the job.

2. The post-processing apparatus according to claim 1, wherein the controller is configured to execute a first job of the plurality of jobs which is a printing output based on a first printing request and a second job of the plurality of jobs which is a printing output based on a second printing request, and the controller is configured to control the shift mechanism to shift a first at least one sheet in the first job towards the first direction and to shift at least one sheet in the second job towards the second direction, wherein when at least one bundle of the plurality of sheet bundles is stapled, the controller does not shift all of the plurality of sheet bundles included in the job.

3. The post-processing apparatus according to claim 1, wherein the controller is configured to execute a first job of the plurality of jobs which is a printing output based on a first printing request, a second job of the plurality of jobs which is a printing output based on a second printing request, and a third job of the plurality of jobs which is a printing output based on a third printing request in the order of the first job, the second job and the third job, and the controller is configured to control the shift mechanism to shift a first sheet or a first part and a last sheet or a last part in the first job towards the first direction, to discharge a first sheet or a first part and a last sheet or a last part in the second job to the reference position and to shift a first sheet or a first part and a last sheet or a last part in the third job towards the second direction.

4. The post-processing apparatus according to claim 3, wherein the controller is configured to control a shift operation toward the first direction for an odd-numbered job and to control a shift operation toward the second direction for an even-numbered job.

5. The post-processing apparatus according to claim 1, wherein the controller is configured to control alignment of the sheet while shifting the sheet in the first direction or the second direction.

6. The post-processing apparatus according to claim 1, wherein the controller is configured to control the shift mechanism to shift at least one of a first sheet or a first portion of a first job of the plurality of jobs and at least one of a last sheet or a last portion in the first job towards the first direction.

7. An image forming system for forming an image on a sheet, comprising a post-processing apparatus, wherein the post-processing apparatus comprises a sheet discharge tray to which a sheet or a sheet bundle is discharged;

a shift mechanism configured to shift a discharge position of the sheet or the sheet bundle discharged to the sheet discharge tray from a reference position; and a controller configured to control the shift mechanism to divide the sheet or the sheet bundle in a first direction in a direction orthogonal to a conveyance direction of the sheet or the sheet bundle and a second direction opposite to the first direction, control the shift mechanism to shift the sheet bundle for each job of a plurality of jobs, and when a job includes a plurality of sheet bundles, control the shift mechanism to shift more than one bundle of the plurality of sheet bundles included in the job.

8. The image forming system according to claim 7, wherein the controller is configured to execute a first job of the plurality of jobs which is a printing output based on a first printing request and a second job of the plurality of jobs which is a printing output based on a second printing request, and the controller is configured to control the shift mechanism to shift a first sheet or a first part and a last sheet or a last part in the first job towards the first direction and to shift a first sheet or a first part and a last sheet or a last part in the second job towards the second direction.

9. The image forming system according to claim 7, wherein the controller is configured to execute a first job of the plurality of jobs which is a printing output based on a first printing request, a second job of the plurality of jobs which is a printing output based on a second printing request, and a third job of the plurality of jobs which is a printing output based on a third printing request in the order of the first job, the second job and the third job, and the controller is configured to control the shift mechanism to shift a first sheet or a first part and a last sheet or a last part in the first job towards the first direction, to discharge a first sheet or a first part and a last sheet or a last part in the second job to the reference position and to shift a first sheet or a first part and a last sheet or a last part in the third job towards the second direction.

10. The image forming system according to claim 7, wherein the controller is configured to control the shift mechanism to shift at least one of a first sheet or a first portion of a first job of the plurality of jobs and at least one of a last sheet or a last portion in the first job towards the first direction.

11. A post-processing apparatus, comprising:

a sheet discharge tray to which a sheet or a sheet bundle is discharged;

a shifter configured to shift a discharge position of the sheet or the sheet bundle discharged to the sheet discharge tray from a reference position; and a controller configured to control the shifter to change a shift amount from the reference position of the sheet or the sheet bundle as a number of the sheets or as a number of sheet bundles discharged to the sheet discharge tray increases, so as to obliquely stack the sheet or the sheet bundle as viewed from a conveyance direction of the sheet or the sheet bundle, control the shifter to shift the sheet bundle for each job of a plurality of jobs, and when a job includes a plurality of sheet bundles, control the shifter to shift more than one bundle of the plurality of sheet bundles included in the job.

12. The post-processing apparatus according to claim 11, wherein the controller is configured to execute a first job of the plurality of jobs which is a printing output based on a first printing request and a second job of the plurality of jobs which is a printing output based on a second printing request, and the controller is configured to perform control of the shifter to change a shift amount towards a first direction in a direction orthogonal to the conveyance direction as the number of the sheets or the sheet bundles increases to obliquely stack the sheet or the sheet bundle as viewed from the conveyance direction in the first job, and to change a shift amount towards a second direction opposite to the first direction as the number of the sheets or the number of sheet bundles increases to obliquely stack the sheet or the sheet bundle as viewed from the conveyance direction in the second job.

13. The post-processing apparatus according to claim 12, wherein the controller is configured to perform a control of the shifter to reduce the shift amount towards the first direction as the number of sheets or the number of sheet bundles increases.

14. The post-processing apparatus according to claim 12, wherein the controller is configured to set the shift amount toward a sheet width direction to be greater when a number of placed sheets is equal to or greater than a threshold value.

15. An image forming system for forming an image on a sheet, comprising a post-processing apparatus, wherein the post-processing apparatus comprises a sheet discharge tray to which a sheet or a sheet bundle is discharged;

a shifter configured to shift a discharge position of the sheet or the sheet bundle discharged to the sheet discharge tray from a reference position; and a controller configured to control the shifter to change a shift amount from the reference position of the sheet or the sheet bundle as a number of sheets or a number of sheet bundles discharged to the sheet discharge tray increases to obliquely stack the sheet or the sheet bundle as viewed from the conveyance direction of the sheet or the sheet bundle, control the shifter to shift the sheet bundle for each job of a plurality of jobs, and when a job includes a plurality of sheet bundles, control the shift mechanism to shift more than one bundle of the plurality of sheet bundles included in the job.

16. The image forming system according to claim 15, wherein the controller is configured to perform a control of the shifter to reduce the shift amount towards the first direction as the number of sheets or the number of sheet bundles increases.

17. The image forming system according to claim 15, wherein the controller is configured to control the shifter so as to cause only outer ends of a plurality of sheets to be inclined as viewed in the conveyance direction.

18. A control method by a post-processing apparatus comprising a sheet discharge tray to which a sheet or a sheet bundle is discharged, and a shift mechanism, the method comprising:

controlling shifting, by the shift mechanism, a discharge position of the sheet or the sheet bundle discharged to the sheet discharge tray from a reference position; and controlling the shift mechanism to divide the sheet or the sheet bundle in a first direction in a direction orthogonal to a conveyance direction of the sheet or the sheet bundle and a second direction opposite to the first direction, controlling the shift mechanism to shift the sheet bundle for each job of a plurality of jobs, and when a job includes a plurality of sheet bundles, controlling the shift mechanism to shift more than one bundle of the plurality of sheet bundles included in the job.

19. The control method according to claim 18, further comprising:

executing a first job of the plurality of jobs which is a printing output based on a first printing request and a second job of the plurality of jobs which is a printing output based on a second printing request, and controlling the shift mechanism to shift a first sheet or a first part and a last sheet or a last part in the first job towards the first direction and to shift a first sheet or a first part and a last sheet or a last part in the second job towards the second direction.

20. The control method according to claim 18, further comprising:

executing a first job of the plurality of jobs which is a printing output based on a first printing request, a second job of the plurality of jobs which is a printing output based on a second printing request, and a third job of the plurality of jobs which is a printing output based on a third printing request in the order of the first job, the second job and the third job, and controlling the shift mechanism to shift a first sheet or a first part and a last sheet or a last part in the first job towards the first direction, to discharge a first sheet or a first part and a last sheet or a last part in the second job to the reference position and to shift a first sheet or a first part and a last sheet or a last part in the third job towards the second direction.

* * * * *